United States Patent [19]

Severson

[11] Patent Number: 4,951,029

[45] Date of Patent: Aug. 21, 1990

[54] MICRO-PROGRAMMABLE SECURITY SYSTEM

[75] Inventor: Paul K. Severson, Richfield, Minn.

[73] Assignee: Interactive Technologies, Inc., St. Paul, Minn.

[21] Appl. No.: 156,547

[22] Filed: Feb. 16, 1988

[51] Int. Cl.[5] ..... G08B 29/00

[52] U.S. Cl. ..... 340/506; 340/531; 340/539; 340/532; 340/533; 340/534

[58] Field of Search ..... 340/506, 531, 532, 533, 340/539, 825.06, 825.69; 379/37, 39, 40, 51

[56] References Cited

U.S. PATENT DOCUMENTS

| | | | |
|---|---|---|---|
| 3,927,404 | 12/1975 | Cooper . | |
| 4,361,832 | 11/1982 | Cole | 340/506 |
| 4,392,125 | 7/1983 | Iwata | 340/505 |
| 4,400,694 | 8/1983 | Wong et al. | 340/505 |
| 4,523,184 | 6/1985 | Abel | 340/531 |
| 4,581,606 | 4/1986 | Mallory | 340/505 |
| 4,660,024 | 4/1987 | McMaster | 340/506 |
| 4,688,183 | 8/1987 | Carll et al. | 340/506 |
| 4,692,742 | 9/1987 | Raizen et al. | 340/531 |
| 4,737,770 | 4/1988 | Brunius et al. | 340/506 |
| 4,749,985 | 6/1988 | Corsberg | 340/506 |

*Primary Examiner*—Donnie L. Crosland
*Attorney, Agent, or Firm*—Douglas L. Tschida

[57] ABSTRACT

A security alarm network including a plurality of microprocessor-based, subscriber system controllers, wherein each controller is capable of responding to a plurality of distributed wireless and hardwired sensors/transducers and is programmable via user, central station and installer-entered system and network parameters. Each system controller is operable to (a) monitor neighbor system communications and system identification data; (b) maintain a central station programmable identification listing of neighboring systems and, if communication malfunctions occur, communicate with the central station via one or more cooperating neighbor controllers; (c) self-learn the identification data of its distributed sensors; (d) maintain operator and central station-accessible event histories; (e) self-confirm predetermined emergency conditions; (f) regulate communications with the central station relative to pre-programmed, grouped, arming level dependent responses and system parameters; and (g) enable audible monitoring by the central station.

27 Claims, 18 Drawing Sheets

| | | |
|---|---|---|
| FIG. 3a | FIG. 3b | FIG. 3c |

FIG. 3

| | | |
|---|---|---|
| FIG. 2a | FIG. 2b | FIG. 2c |
| FIG. 2d | FIG. 2e | FIG. 2f |
| FIG. 2g | FIG. 2h | FIG. 2i |

FIG. 2

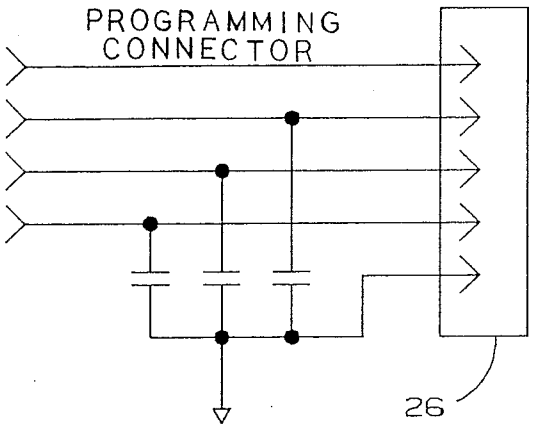
FIG. 2c
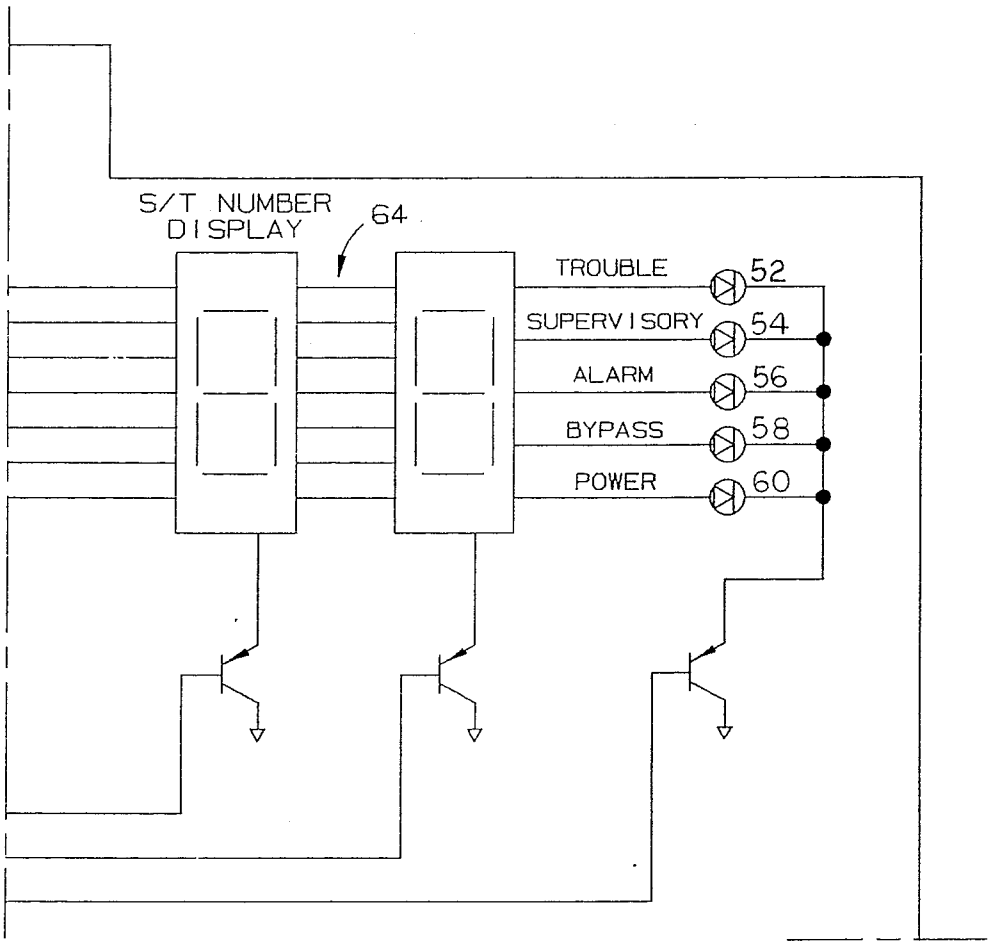

MICRO-PROGRAMMABLE SECURITY SYSTEM

BACKGROUND OF THE INVENTION

The present invention relates to programmable security alarm systems and, in particular, to an improved system controller which is programmably responsive to a plurality of distributed wireless and hardwired alarm sensors/transducers and which communicates with neighboring system controllers and a central station interactively monitoring a number of subscriber systems.

With the advent of microprocessors and integrated circuitry, the security alarm industry has seen the introduction of a variety of low-end systems capable of meeting the security needs of the average homeowner and small business. Such systems typically are of the hardwired, loop impedance monitoring type and accommodate a limited number of environmental zones; that is, most commonly less than twenty controller identifiable zones are monitorable by way of an equal member of hardwired sensors. Additional sensors may be used but typically are not separately identifiable to the system controller. Alarm annunciation may either occur locally or be reported to a central station via separate phone line connections or radio frequency (RF) transmissions.

Although, too, wireless RF systems have been developed, the two types of systems (i.e. hardwired and wireless) are mutually exclusive of each other and separate controllers are required to respond to the differeing types of sensors/transducers. Conversion circuitry can be used to permit one sensor/transducer type to communicate with another controller (e.g. U.S. Pat. Nos. 3,925,763 and 4,446,454), but must be replicated for each sensor. This limits the upgradability of an installed system and increases cost.

Appreciating too the limited installation size accommodated by most available systems, a need exists therefore for a system controller having greater zonal capacity and able to accommodate both hardwired and wireless sensors. Such a controller could be adapted to the needs of larger installations, as well as facilitate the upgrading of existing systems, regardless of type. Applicant particularly believes an expandable, wireless system controller can best accommodate these ends.

As regards the desirable features of such a system, Applicant is aware of a number of systems and controllers which are responsive to a plurality of distributed hardwired transducers. These systems can be found upon directing attention to U.S. Pat. Nos. 3,848,231; 4,001,819; 4,228,424; and 4,465,904. The controllers of such systems, however, are responsive to hardwired transducers only, as opposed to either hardwired or wireless transducers. The transducers are also not separately programmable.

Applicant is also aware of U.S. Pat. Nos. 3,927,404; 4,203,096; 4,257,038; 4,581,606 and Applicant's own pending U.S. application Ser. No. 06/837,208, filed Mar. 10, 1986 and entitled "SECURITY SYSTEM WITH PROGRAMMABLE SENSOR AND USER DATA INPUT TRANSMITTERS" which disclose systems having controller identifiable sensors, some of which sensors are electrically programmable. Again, however, the controllers of these systems are not directly responsive to both wireless and hardwired sensors/transducers.

Applicant is also aware various of the above-mentioned systems include controllers which communicate detected sensor data, along with user specific data, such as billing account numbers and the like, to a central station by way of provided phone lines and/or an RF link. Furthermore, ones of such system controllers are programmably responsive to user/installer-entered access codes and delay periods. However, it is not believed any of such systems are capable of simultaneously responding equally to hardwired or wireless sensors, nor communicating in a network arrangement via neighboring system controllers to a common central station. Moreover, none of such system controllers are believed to be operative to self-learn the identities of their various distributed sensors, among a variety of other features provided for in the presently improved system controller.

SUMMARY OF THE INVENTION

It is accordingly a primary object of the present invention to provide a programmable system controller simultaneously responsive to an increased number of separately programmable wireless and hardwired sensors/transducers, having maximized configuration flexibility and adaptable to a network configuration interactively communicating with a common central station which monitors a plurality of other subscriber systems including similarly constructed system controllers.

It is an additional object of the invention to provide a network wherein each system controller has greater amounts of system data available, as well as network data, and communications with the central station can be selectively controlled.

It is a further object of the invention to provide an installer-friendly system with alternative programming modalities and expanded sensor reporting capabilities, wherein sensor identification data is self-logged into a system controller memory, wherein selected sensors can be bypassed and wherein defective sensors can be more readily detected.

It is a further object of the invention to provide a plurality of user and central station programmable levels of access codes for controlling access to the system and the arming level of the secured site.

It is a further object of the invention to enable neighboring system controllers to monitor and access, under selected circumstances, the communication capabilities of one another, and to permit the central station to program which neighbors respond to which other neighbors.

It is a still further object of the invention to provide a system controller operative relative to stored listings of programmable sensor/transducer numbers, system arming levels and a variety of programmable parameters and options to respond per pre-programmed, grouped sensor/transducer response data.

The foregoing objects and advantages are achieved in the present invention in a security alarm network including a plurality of similarly constructed microprocessor-based system controllers. The central processor of each system controller is supported by pre-programmed internal and external read only and random access operating memories. In particular, the external default read only memory (ROM) and programmable random access memory (RAM) define system operation relative to a plurality of grouped, separately programmable wireless and hardwired sensor/transducer numbers and a plurality of system arming levels. A plurality of system parameters, options and features are also programmably available to tailor each controller to a desired operation and configured hardware. An integrated system power controller, telephone communication means, radio frequency communication link, four-wire sensor bus, hardwired transducer control circuitry reponsive to a plurality of hardwire and "Pinpoint" input modules, display means and external annunciator means complete the assembly.

In addition to a plurality of enhanced programmable functions, each system controller is interactively responsive to the central station and user and is operative to self-learn the identity of its assigned sensors; maintain a chronological, central station accessible log of all reported alarm conditions; permit the central station to audibly monitor a secured premises; directly program transducers from the controller; access the system controller of one of a plurality of neighboring systems during a phone failure condition; and delay reporting an alarm until multiple sensors/transducers confirm the presence of an alarm condition.

The foregoing objects, advantages and distinctions of the invention, along with its detailed construction, will become particularly apparent upon directing attention to the following description with respect to the appended drawings. It is to be appreciated the description is made by way of the presently preferred embodiment only and assumes the reader to be one of skill in the art. It is not intended to be all-encompassing in scope, but rather only be descriptive of the presently preferred mode and should not be interpreted in any respect to be self-limiting. To the extent modifications or improvements may have been considered, they are described as appropriate.

BRIEF DESCRIPTION OF THE DRAWINGS

FIG. 2, including FIGS. 2*a* through 2*i*, shows a detailed schematic diagram of the system controller.

DESCRIPTION OF THE PREFERRED EMBODIMENT

Figure 1:
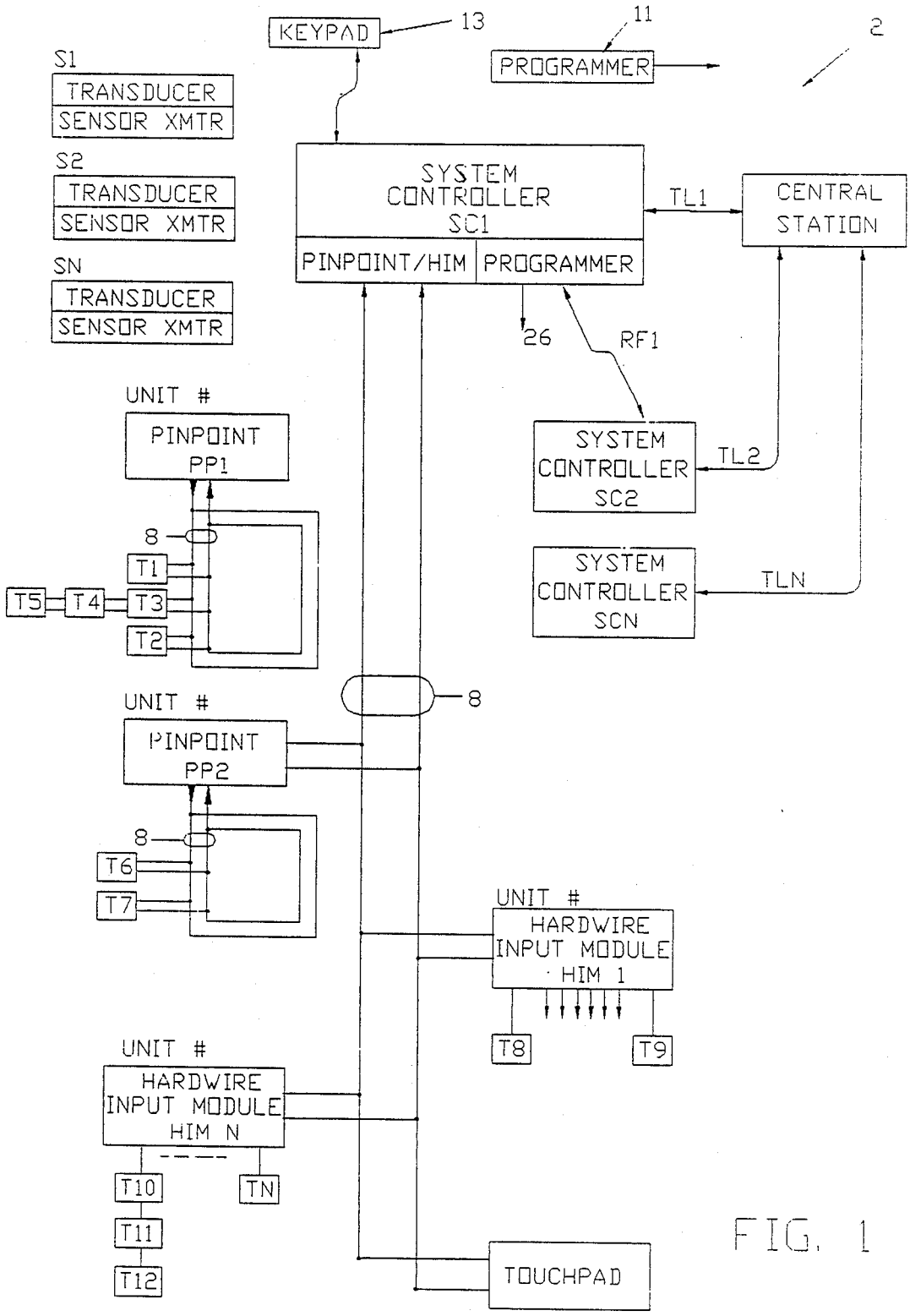
FIG. 1 shows a generalized block diagram of a typical system and network of neighboring systems relative to a multi-subscriber central station.

Referring to FIG. 1, a generalized block diagram is shown of a typical security network 2 such as might be found within any number of cities or locales wherein a central station 4 monitors a number of subscriber systems, each of which systems are controlled by an alarm controller SC1 through SCN. Each subscriber may comprise an individual residence, industrial or office site, but all of which communicate with the central station 4 via commercially available telephone lines TL1, TL2 through TLN. Depending on the subscriber system, multiple phone lines may be provided to the central station 4 to allow the system controller to sequentially access one or the other of the lines to report system data (reference the PModes of Table 10).

With particular attention directed to the subscriber system centering about the system controller SC1, each subscriber system includes a similarly constructed system controller which is tailor programmed to the subscriber's needs and which generally communicates with a number of distributed hardwired and/or wireless sensors/transducers that may be arranged in a variety of configurations. Consequently, depending upon the type of responding sensor or transducer, communications with the system controller can occur over either a radio frequency (RF) transmission link or a hardwired link, bus 8 per defined protocols established for each mode of communication. Although too the system controllers are operationally similar to one another, their modular circuitry and programming may differ relative to the number, type and arrangements of sensors/transducers, but which will become more apparent hereinafter.

The subscriber system of the system controller SC1 includes a number of distributed wireless sensors S1 through SN. Each sensor is comprised of interconnected transducer and sensor transmitter portions which appropriately communicate with the system controller SC1 via encoded radio frequency transmissions. The transducer portions monitor a physical alarm condition and the state of which is communicated by the closely associated transmitter portion to the system controller SC1. The transducer portion may consist of a variety of conventional NO/NC momentary contact switches, fire/smoke, motion, traffic or audio detectors. The transmitter portion, in turn, periodically programmably transmits status data, along with identification data defining a house code and a sensor/transducer number, to the controller SC1 relative to previously programmed operating or preconditioning parameters established at the time of installaton. More of the details of the construction and operation of the sensors S1 through SN can be found upon directing attention to Applicant's co-pending U.S. patent application, Ser. No. 06/837,208, filed Mar. 10, 1986, and entitled "SECURITY SYSTEM WITH PROGRAMMABLE SENSOR AND USER DATA INPUT TRANSMITTERS".

Otherwise, also coupled to the system controller SC1 via a hardwired, four-wire bus 8, including power, ground, Data In and Data Out conductors, are a number of transducers T1 through TN coupled to intervening, so-called "Pinpoint" modules PP1 through PPN and "hardwired" input modules HIM1 through HIMN. Of the four conductors, only the Data In/Out conductors are shown. As presently configured, each system controller accommodates a mixture of up to a combined total of eight Pinpoint or hardwired modules, with any mixture of the module types or up to eight or either type and none of the other type. Any number of hardwire transducers within the limitations of the modules and zonal capabilities of the controller may thus be coupled to the bus 8.

Like the sensors S1 through SN, the transducers T1 through TN via the Pinpoint and HIM modules monitor various environmental conditions such as the status of a window, door, fire alarm, floor mat sensor, motion detector or other alarm device. Instead of using an RF communications link, the modules report their transducers' status data over the Data In/Out conductors of the hardwired bus 8. It is the Pinpoint and HIM modules which allow the system controllers SC1 to SCN to mate with existing hardwired systems and expand their capabilities to accommodate still other hardwired and wireless transucers and sensors.

Referring to the Pinpoint modules PP1 and PP2 and their associated transducers T-1–T-7, it again is to be appreciated that up to eight such modules can be coupled to each controller and between which any number of transducers can be arranged in configurations like that shown for the PP1 module. Each module, regardless of type, is assigned a decimal unit number from 0 to 7 which identifies the controller SC1 and the portion of its circuitry that responds to Pinpoint/HIM transmissions. Each Pinpoint module is further programmed at installation with identification numbers for each of its transducers with the system controller's internal programmer and a touch circuit coupled to the bus 8 or a wireless keypad 13. identification data comprises a six-bit sensor/transducer (S/T) or zone number (reference Tables 4 and 5) like that assigned to each wireless sensor S1 to SN, except which, in lieu of a unit number, are assigned a code. Each sensor/transducer is thus identified by the controller SC1.

As described, a desired number of transducers may be identitiably coupled to the looped bus 8′ of each Pinpoint module in various fashions. For example and as with the transducers T1, T2 and T6, T7, each transducer is coupled in parallel to its module's looped bus 8′ which transducers are separately identifiable by way of the assigned unit and S/T numbers which are stored in the Pinpoint modules PP1 and PP2 and accessed as the transducers respond.

Situations may exist, as with transducers T3, T4 and T5, which are series/parallel coupled to one another and the bus 8′, where the transducers are not separately identifiable. In this instance, the Pinpoint module can be programmed to identify an alarm to the transducers as a group or a specific zone of the premises only; that is, the sub-loop 8″, and not a specific window, door or the like. Thus, a number of transducers can be assigned a single identification number.

Where too alarm and supervisory transmissions from the sensors S1 to SN may occur at any time, those from the Pinpoint transducers T1 to T7 and hardwired input module transducers T8 to TN are consigned to occur on a time multiplexed basis relative to one another and the controller SC1. That is, during regularly repeating time windows and in response to control signals from the controller over the Data Out conductor, each of the eight possible Pinpoint and HIM modules, along with the others, reports the status of one of its transducers. The collective status data is received at the controller over the Data in conductor, where it is organized into a defined format by a Pinpoint/HIM interface buffer.

The controller's central processor unit (CPU), in turn, monitors the Pinpoint/HIM buffer to access preprogrammed response data relative to the particularly responding transducers and a user assigned system arming level. Any detected activity is logged into a chronologically maintained event buffer and, depending upon its significance, may also be reported to the central station 4 and/or induce local annunciation activity. The time windows are also relatively short (i.e. 125 milliseconds), such that if two or more alarms are simultaneously reported to any one module, they are sequentially communicated and processed over the next successive time windows. Any concurrent RF sensor activity is interleaved with the hardwired transducer activity at the CPU and similarly reported depending upon the particular programmed response for each reporting sensor/transducer identification number at the particularly programmed arming level. Most important to the user, however, is that the system response to any multiply detected alarm activity appears simultaneous.

Relative to the general construction and operation of each Pinpoint module, attention is particularly directed to Applicant's co-pending U.S. patent application, Ser. No. 06/894,098, filed Aug. 8, 1986, and entitled "MULTIPLEXED ALARM SYSTEM". A better appreciation can be had therefrom as to the manner in which each module's circuitry monitors and responds to the transducers T1 through T7.

Depending again upon the installation, up to eight hardwire input modules may be coupled to the bus 8. Each HIM module is capable of serving up to eight transducers. Like the Pinpoint modules, each HIM module has an assigned unit or number and each unit is allotted a specific portion of every other 125 millisecond time window in which to report the status of one of its sensors.

Whereas the transducers coupled to the buses 8′ and 8″ are individually identifiable, except possibly those of bus 8″, the transducers T8 to TN coupled to the HIM modules do not have separately assigned identification numbers. Instead, each of the eight ports of each module is assigned a specific identification number and all transducers coupled thereto are identified in mass. In the latter instance, all such transducers are again commonly found within a physically confined or localized area of the protected site, such as window contacts. Consequently, if an alarm occurs at one of the multi-transducer input ports of one of the HIM modules, it is necessary to physically inspect the premises to determine which transducer is in its alarm state.

The HIM modules HIM1 through HIMN find particular application with pre-existing transducers. That is, where a system is being upgraded, the system controller SC1 can be added and zonally coupled via the Pinpoint and HIMs to a variety of the existing transducers, without having to re-do the entire system. Additional wireless and hardwired transducers can later be added as required to take advantage of the enhanced capabilities of the controller SC1. The subscriber is thus assured of system integrity, with minimal switch-over costs, as the pre-existing system is upgraded. For the subscriber who is somewhat reluctant to try or has concern about a completely wireless installation, the modular wireless/-hardwired capabilities of the subject invention are particularly advantageous. Most importantly, however, the controller SC1 is responsive to transmissions from both wireless and hardwired sensors/transducers.

Whereas too the system controller SC1 principally communicates with the central station 4 via the telephone link TL1, it may also communicate with one or more of the neighboring controllers SC2 to SCN via a separately provided RF communications link RF1. That is, under certain circumstances, the controller SC1 is programmably operable to communicate with one or more of the neighboring controllers SC2 through SCN so long as these controllers are within the transmision range and include a receiver responding to the same frequency as SC1's RF1 transmitter. The transmitter range typically is one-fourth of a mile.

At present, the CPU would operate the RF1 transmitter only during an alarm condition and only if the controller SC1 was unable to access its telephone link TL1 to the central station 4. Upon one or more neighbor systems detecting SC1's transmission, the neighbors communicate SC1's assigned account number and inability-to-communicate or phone failure condition to the central station 4 via their own phone links TL2 through TLN, which in turn takes appropriate action. Depending on other programmed parameters, local alarms may also sound at the SC1 subscriber site. Similarly and if programmed, any of the controllers SC2 through SCN might under similar circumstances obtain communications assistance from SC1 or another neighbor. Thus, the network 2 provides for uninterruptable communications with the central station 4 via its "buddy" capabilities and the neighboring system communication links. An intruder thus no longer can defeat a system merely by defeating the phone link.

Directing attention to FIG. 2 and FIGS. 2*a* through 2*i*, a detailed schematic diagram is shown of the circuitry of the system controller SC1 of FIG. 1. This circuitry is duplicated in each of the other system controllers SC2 through SCN which enables the foregoing "buddy" and wireless/hardwired capabilities of the network 2 and each subscriber system.

The controller SC1 is configured about a microprocessor implemented CPU 10, whose operation is responsively controlled relative to the RF inputs from the RF sensors, Data in signals from bus 8 and control signals from the central station 4 over TL1 via a variety of interactive subroutine organized micro instructions stored within associated internal ROM and RAM (not shown). Additional memory is provided via external, factory programmable ROM 12 and RAM 14 (reference FIG. 2*e*).

Coupling the CPU 10 to the external world and subscriber are various input/output support circuitry and power control circuitry. In the latter regard, power controller circuitry 16 (reference FIGS. 2*d* and 2*g*) operates relative to A.C. and back-up storage battery inputs 18 and 20 to at all times provide suitable power to the CPU 10 (reference FIGS. 2*e* and 2*h*) and associated peripheral circuitry. Regulated power is thereby provided as required to the controller SC1 at the appropriate voltage levels, most commonly +5 (+V) or +6.8 (+V1) volts. Also included is circuitry for monitoring and displaying the back-up battery's condition and reporting same to the CPU 10 which, in turn, reports the information to the central station 4 on a programmable basis via the user programmable S/T number 90, but which will be described in greater detail hereinafter.

Figure 2A:
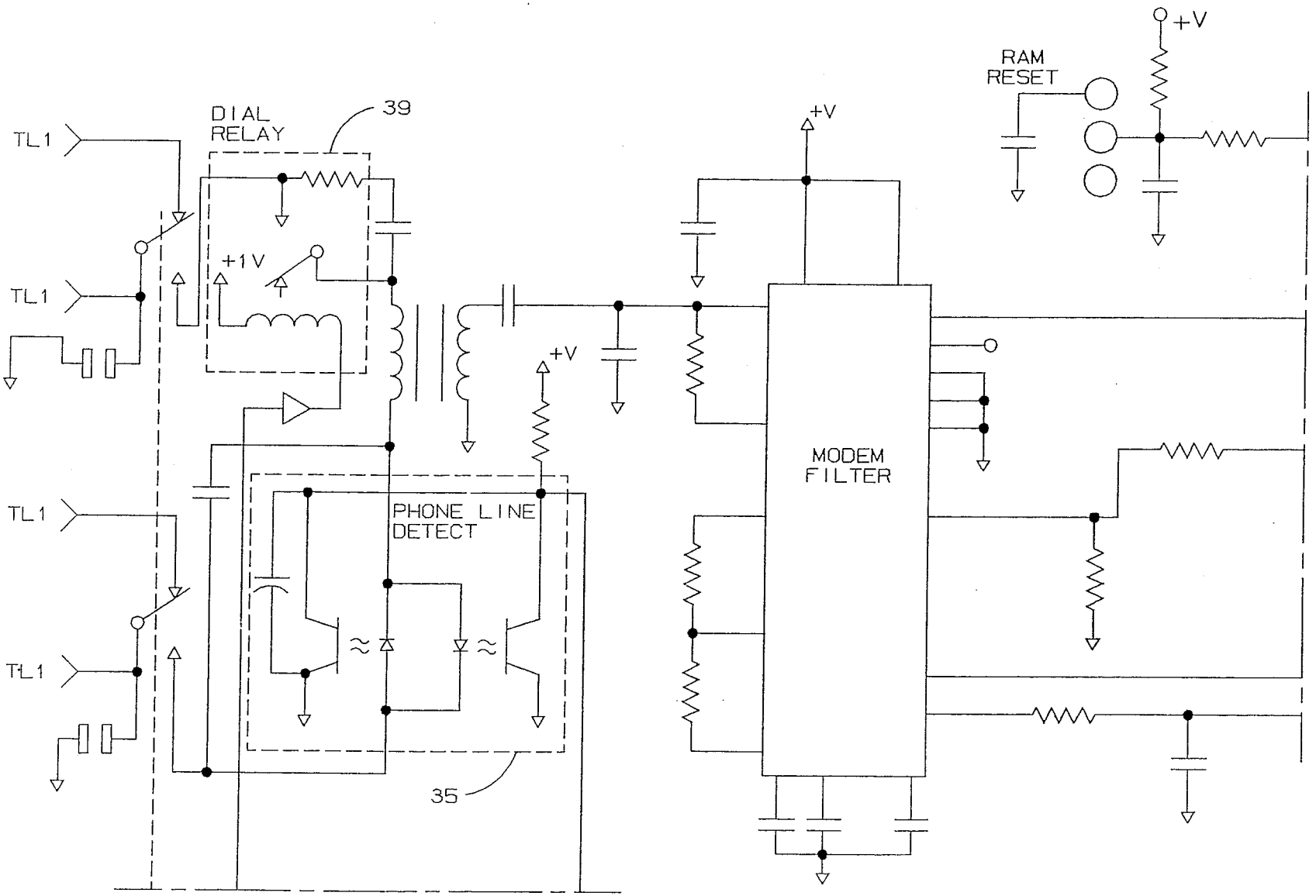
Figure 2B:
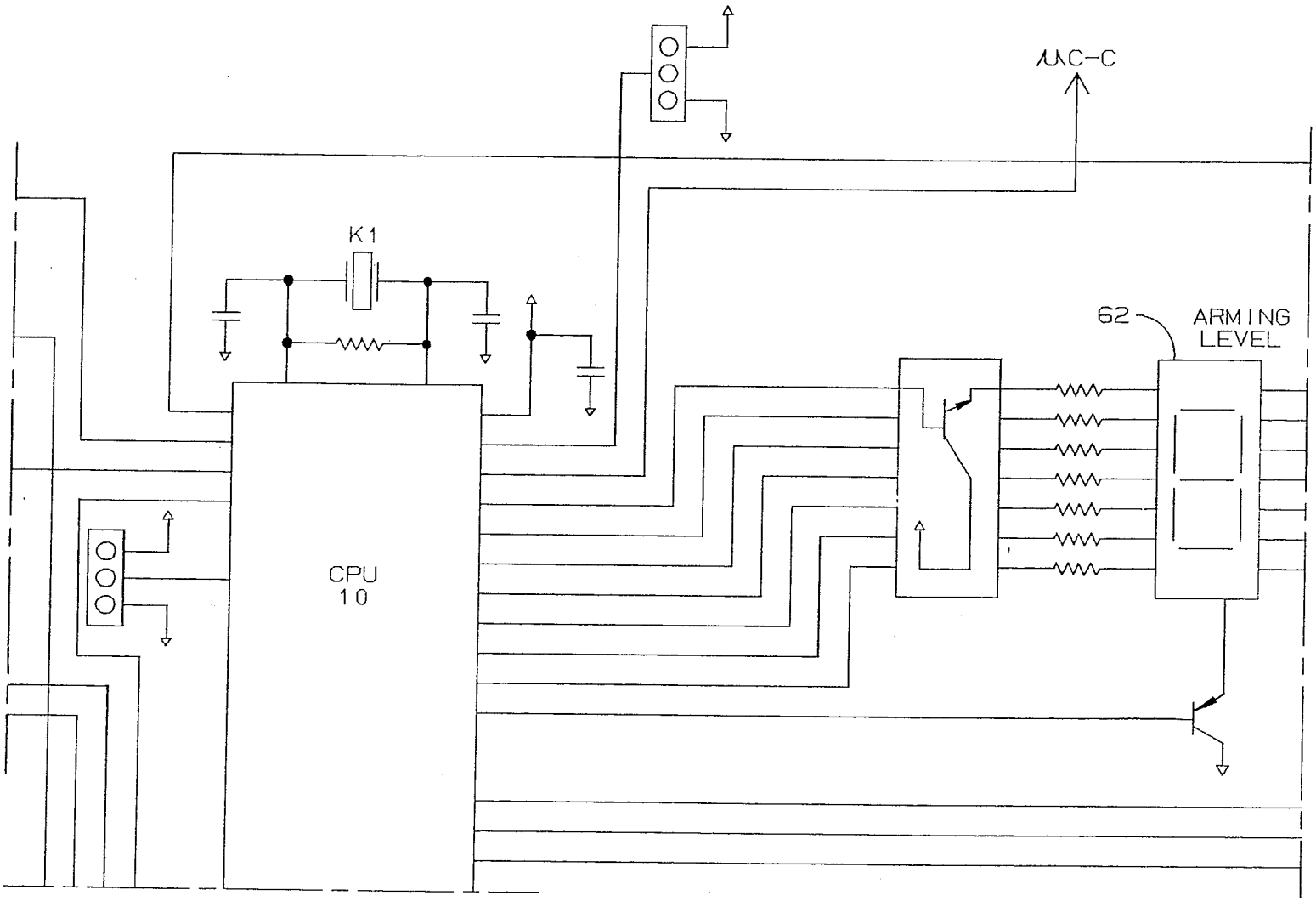
Figure 2D:
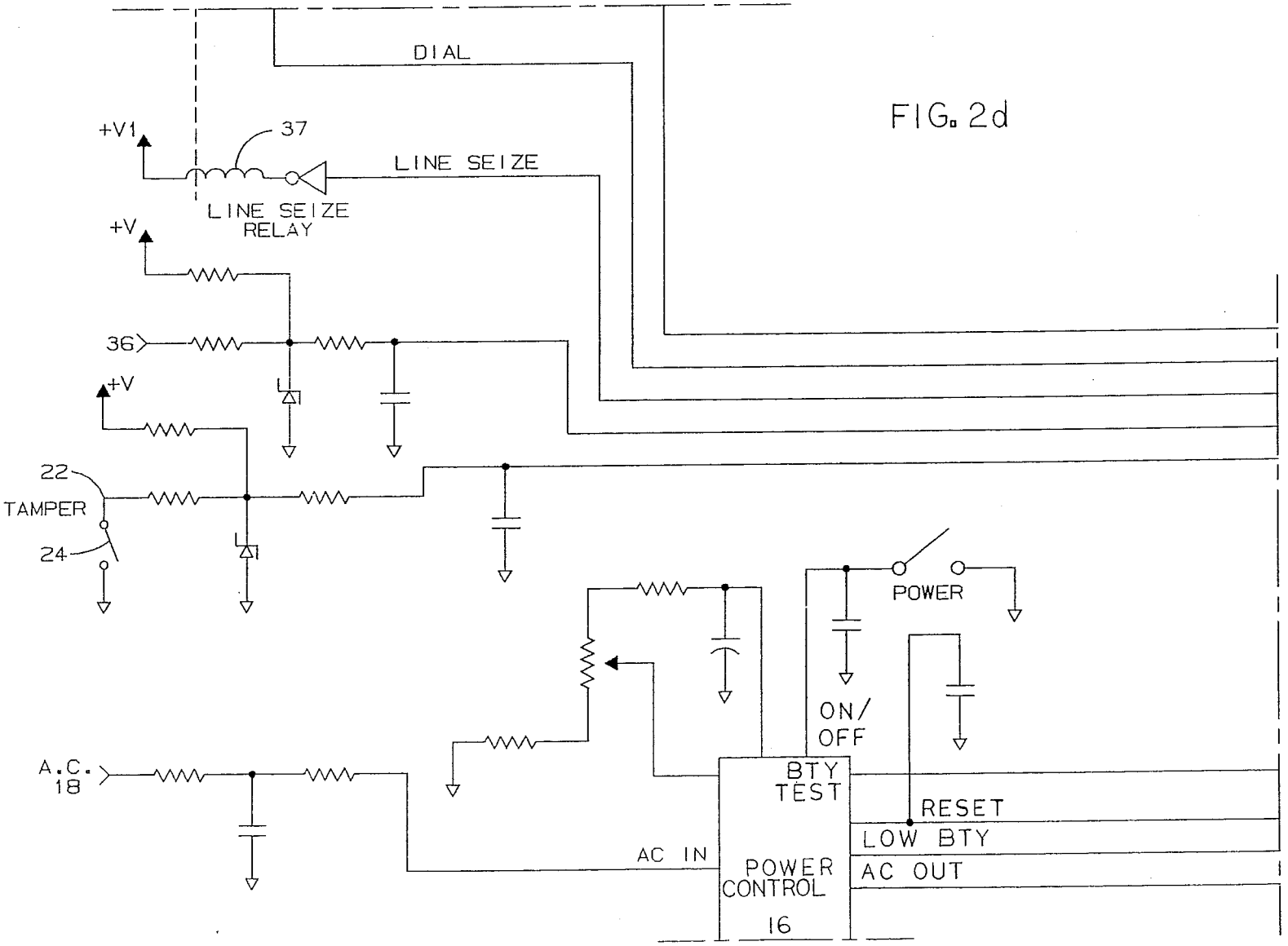
Figure 2E:
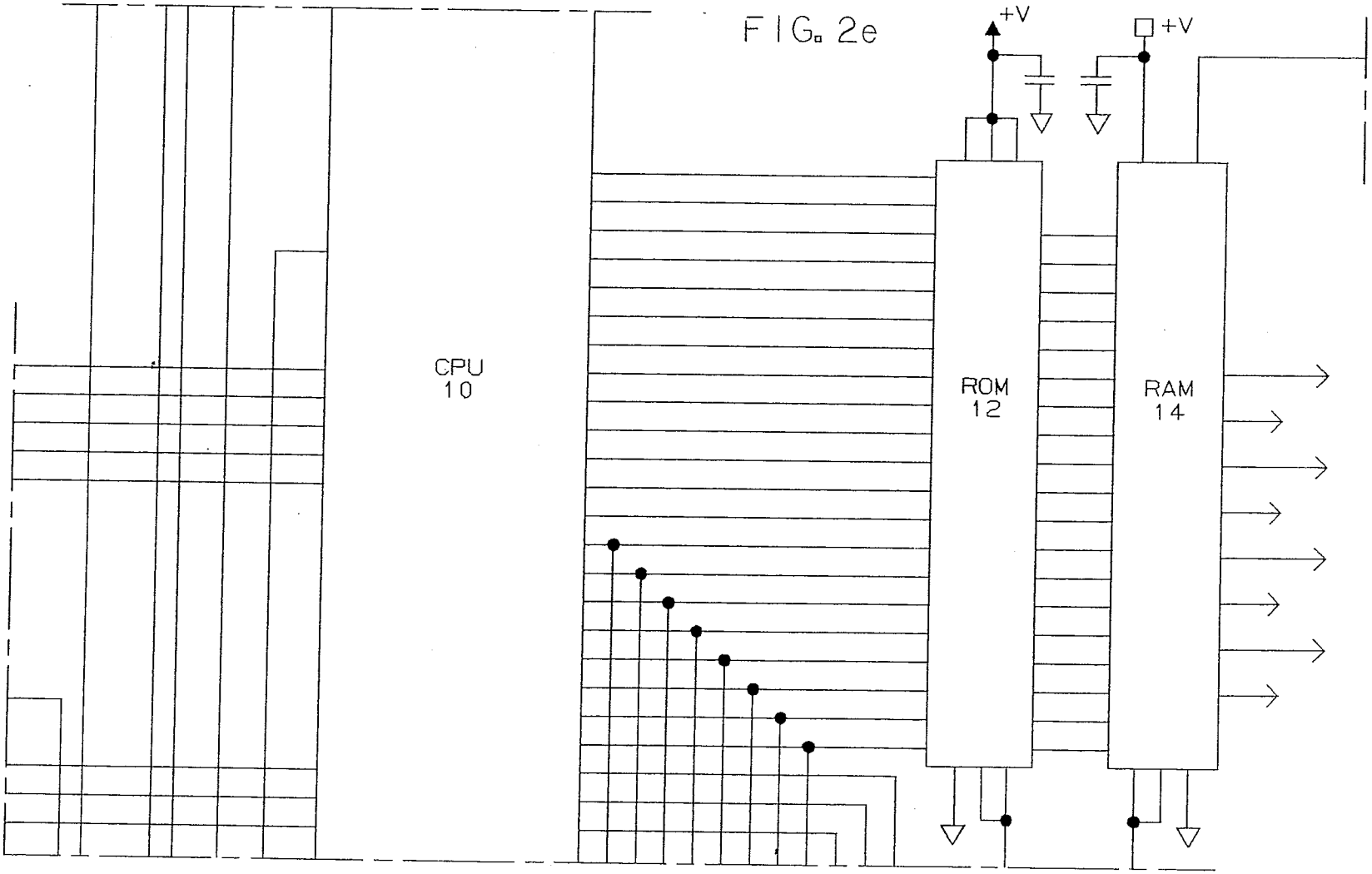
Figure 2F:
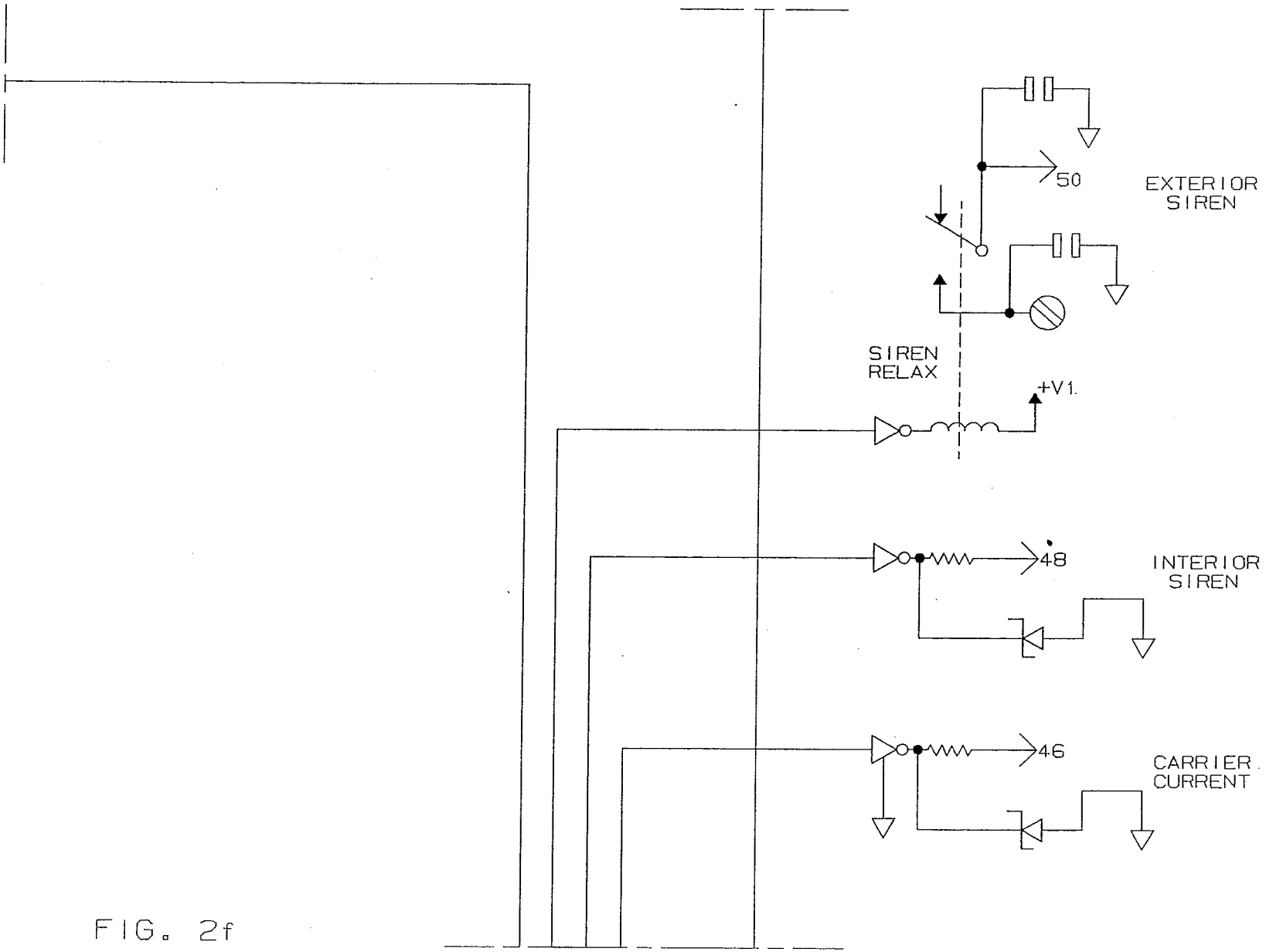

Of the associated input/output circuitry, a tamper condition 22 is obtained from a switch 24 coupled to the system controller cabinetry (reference FIG. 2*d*). The normal switch state is programmable at the CPU 10. An uncorrected change in switch state alerts the CPU 10 and central station 4 to unauthorized entry.

Programming connector 26 (reference FIG. 2*c*) provides a port, like the hand-held programmer 11, whereat one of the wireless sensors S1 to SN may be coupled during system setup. That is, the controller includes internal programmer circuitry for programming the identity and preconditioning parameters of each sensor S1 to SN, as well as the controller SC1, via user-entered data from the multi-keyed, wireless key pad 13 or touchpad 12 coupled to the bus 8 (reference FIG. 2*d*). An audio listen port 28 at a multi-pin connector 30 (reference FIG. 2*i*) is also coupled to CPU 10 which, if included, permits the central station 4 via the CPU 10 to switchably connect an on-site microphone coupled to the port 28 onto the telephone link TL1. A central station operator, assuming proper analog circuitry is provided at the central station 4, can thereby "listen in" to activities at the subscriber's premises.

Figure 2G:
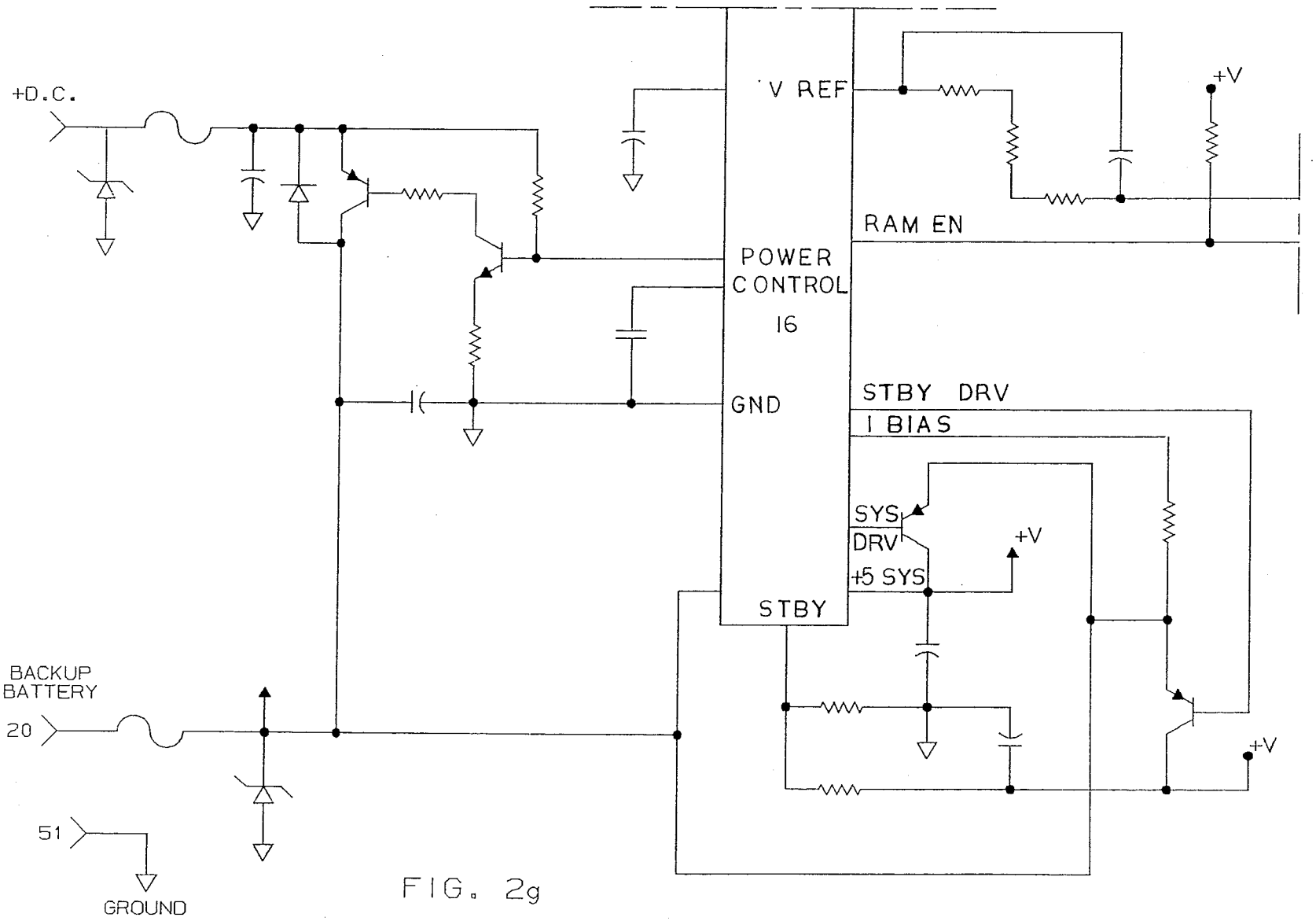
Figure 2H:
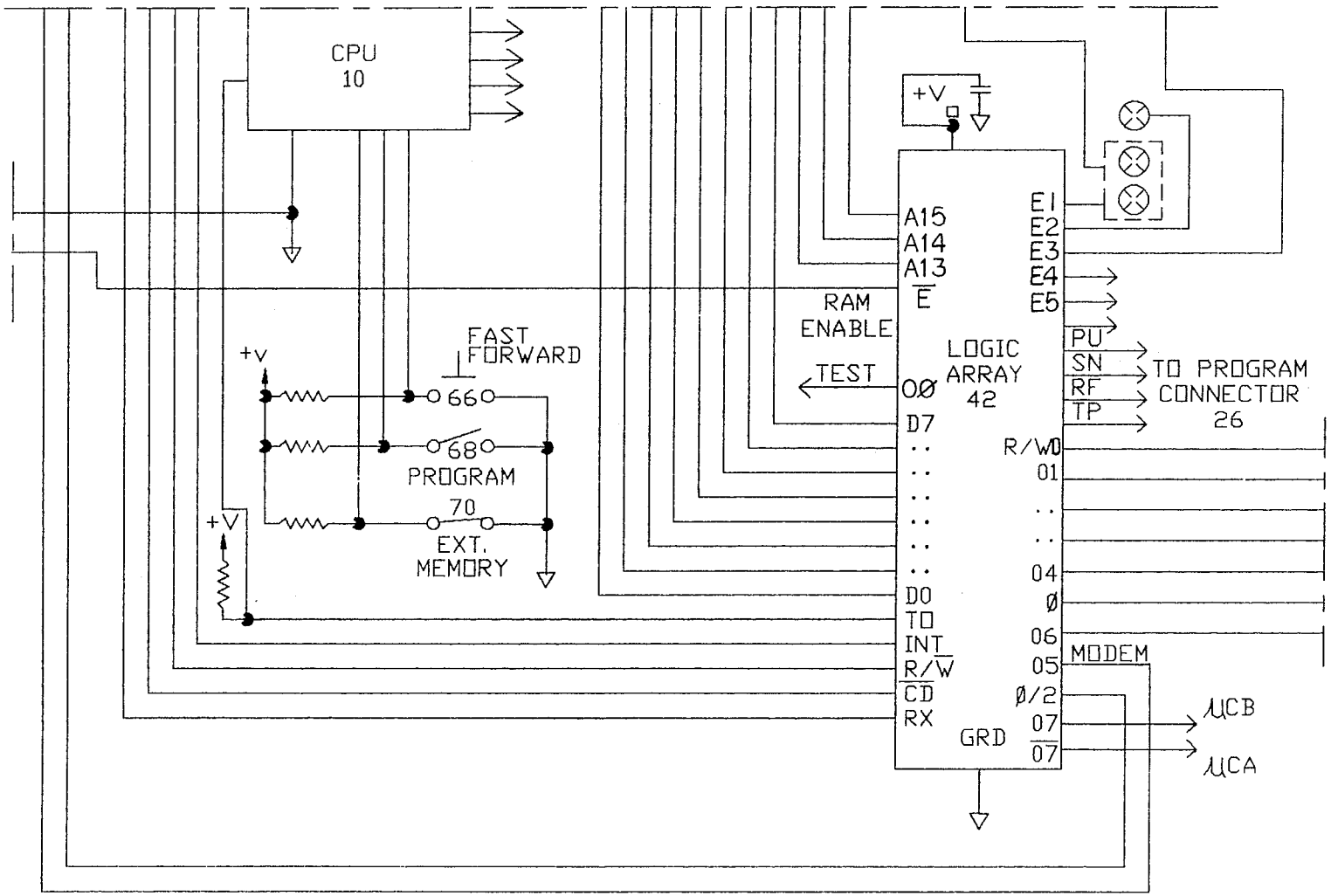
Figure 2I:
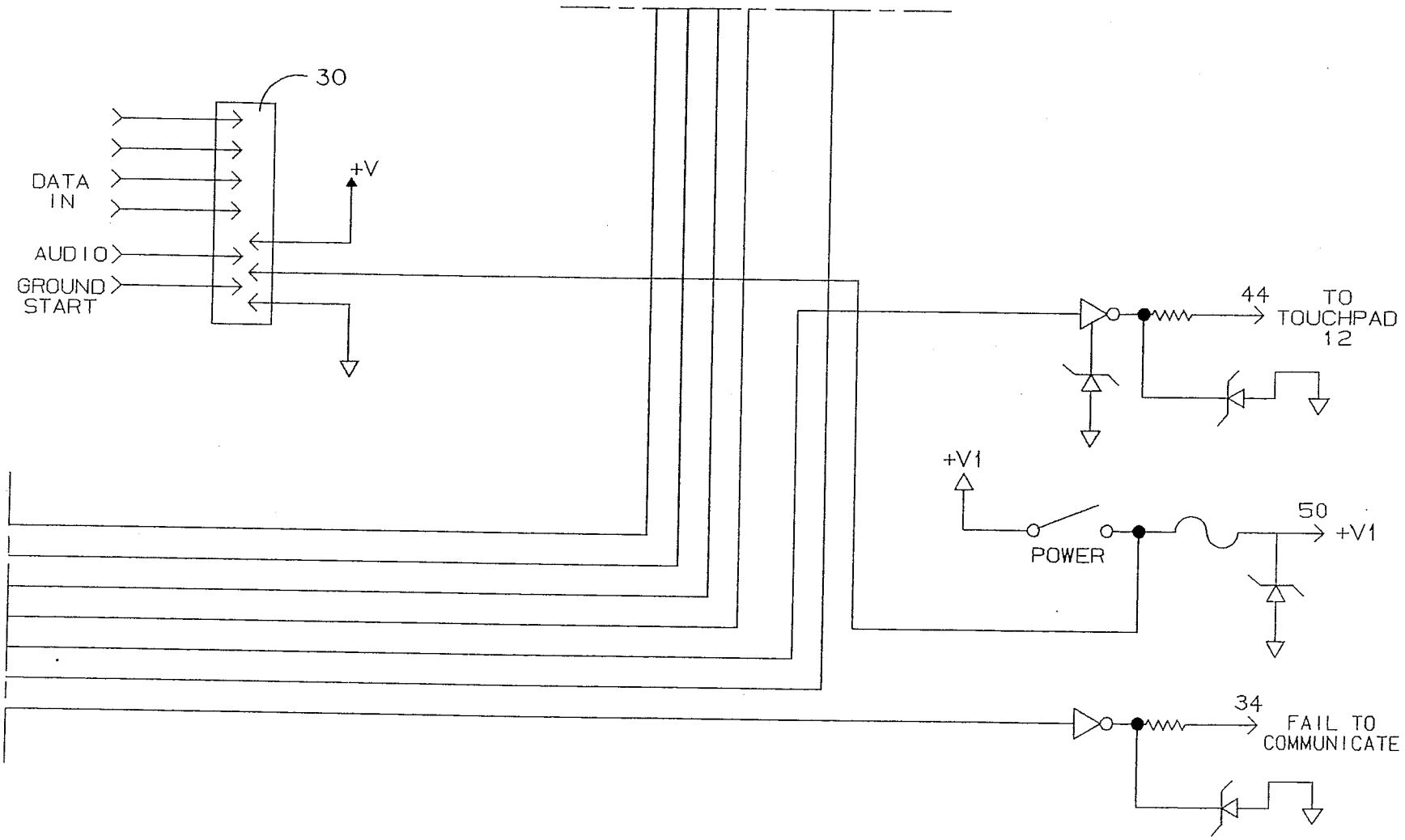

The hardwired Data In Input and the Data Out, ground and +V1 outputs of the output driver circuitry 44, 50 and 51 are coupled to scres terminals at the controller cabinet (reference FIGS. 2*g* and 2*i*). Assuming such hardwired capabilities are desired, such as where an existing hardwired system is being upgraded, it again is necessary for the installer to mount the appropriate modular Pinpoint and HIM circuitry intermediate the particularly defined configurations of hardwired transducers. Although too the Pinpoint circuitry has been shown as being mounted external to the controller, it is to be appreciated it might be mounted within the system controller's cabinetry, along with the Pinpoint/HIM buffer circuitry. In either event, the CPU 10 is able to monitor the associated transducers T1 through TN per a protocol compatible with both types of wireless sensor and hardwired transducer inputs. Reported status and identification information (reference Table 8) is stored in an event buffer and appropriate alarms are reported via an alarm buffer by the CPU 10 to the central station 4.

In this latter regard and relative to the CPU's operation, the inputs of sensors S1 to SN and T1 to TN are treated the same. Each input, except for those of the bus 8" and any of the HIM inputs which include a plurality of serial/parallel coupled transducers, is separately identifiable to the CPU 10 and programmable according to the same criteria described hereinafter. The principal distinction is that, whereas the sensors S1 to SN communicate randomly with the CPU 10, the Pinpoint and HIM modules and transducers T1 through TN communicate in a time multiplexed fashion in 125 millisecond windows for the modularly installed Pinpoint and HIM circuitry. The particular details of such communications as to they relate to the Pinpoint circuitry can, again, be found upon directing attention to the present assignees co-pending U.S. patent application, Ser. No. 06/894,098.

Generally though each Pinpoint module operates relative to a three second polling window, as opposed to a HIM's 125 millisecond operation; although, each module reports status data as it is detected in coincidence the the HIM data. During a three second window, each Pinpoint module transmits a "sync tone" over its bus 8' to all of the coupled transducers and/or identifiable zones which sequentially respond in a time multiplexed fashion. Each identifiable transducer or zone responds with one of three defined tonal conditions (i.e. no tone, tone 1 or tone 2). The Pinpoint circuitry monitors the tonal responses for each assigned S/T number, temporarily stores any alarm responses in an internal buffer which, in turn, it re-transmits to the CPU 10 via bus 8 during the next 125 millisecond window when all the assigned Pinpoint/HIM units report. At present, each Pinpoint transducer is provided 23.3 milliseconds in which to report, which for a single Pinpoint module and bus loop 8' translates to a capability of serving 64 separately programmable and identifiable hardwired transducers for any one of the currently configured Pinpoint modules. The zonal capacity may again, however, be parceled up between a number of other Pinpoint and HIM modules and wireless sensors S1 to SN.

In contrast to the Pinpoint circuitry, the circuitry of each HIM module monitors each of its eight assignable zones in bulk during each 125 millisecond time window. It can do this because each zone, even though having a number of transducers, only grossly reports whether or not an alarm has occurred at one of the transducers, and not the alarms location, even if multiple transducers are in alarm.

In particular, during each window, the CPU transmits data to the HIM/Pinpoint/touchpad modules identifying which modules are to report and in what order. The CPU data also allows the HIM modules to synchronize their responses with the CPU's operation and half or two groups of four of which responses are alternately transmitted during 67 millisecond portions of successive windows with each input module having a pre-assigned portion of the allotted time.

If a HIM/Pinpoint/touchpad module has no information to send, it sends a "null" character in place of a normal character. Each HIM/Pinpoint/touchpad module has its own characteristic null character so the CPU 10, along with the programming of each Pinpoint and HIM unit number, at all times knows what type of modules are connected to the bus 8. If the CPU does not receive any message from one of the system's HIM/Pinpoint/touchpad modules during any given 10-second time period, a preassigned S/T numbered event "77" or supervisory condition is initiated. A 77 appears on display 64 and the supervisory LED 54 is lit. The condition is also reported to the central station 4 and placed in the event buffer, but which will become more apparent hereinafter.

As part of the CPU's transmitted data, four ack/nak flags are sent to each of the HIM modules. These flags advise each responding module whether the CPU received data from the module during the window just before the current window. Bit 8 of the data defines for which HIM modules the ack/nak flags are valid. If bit 8 is a "0" then the flags are for modules 4–7 and if bit 8 is a "1" then the flags are for modules 0–3.

Figure 3A:
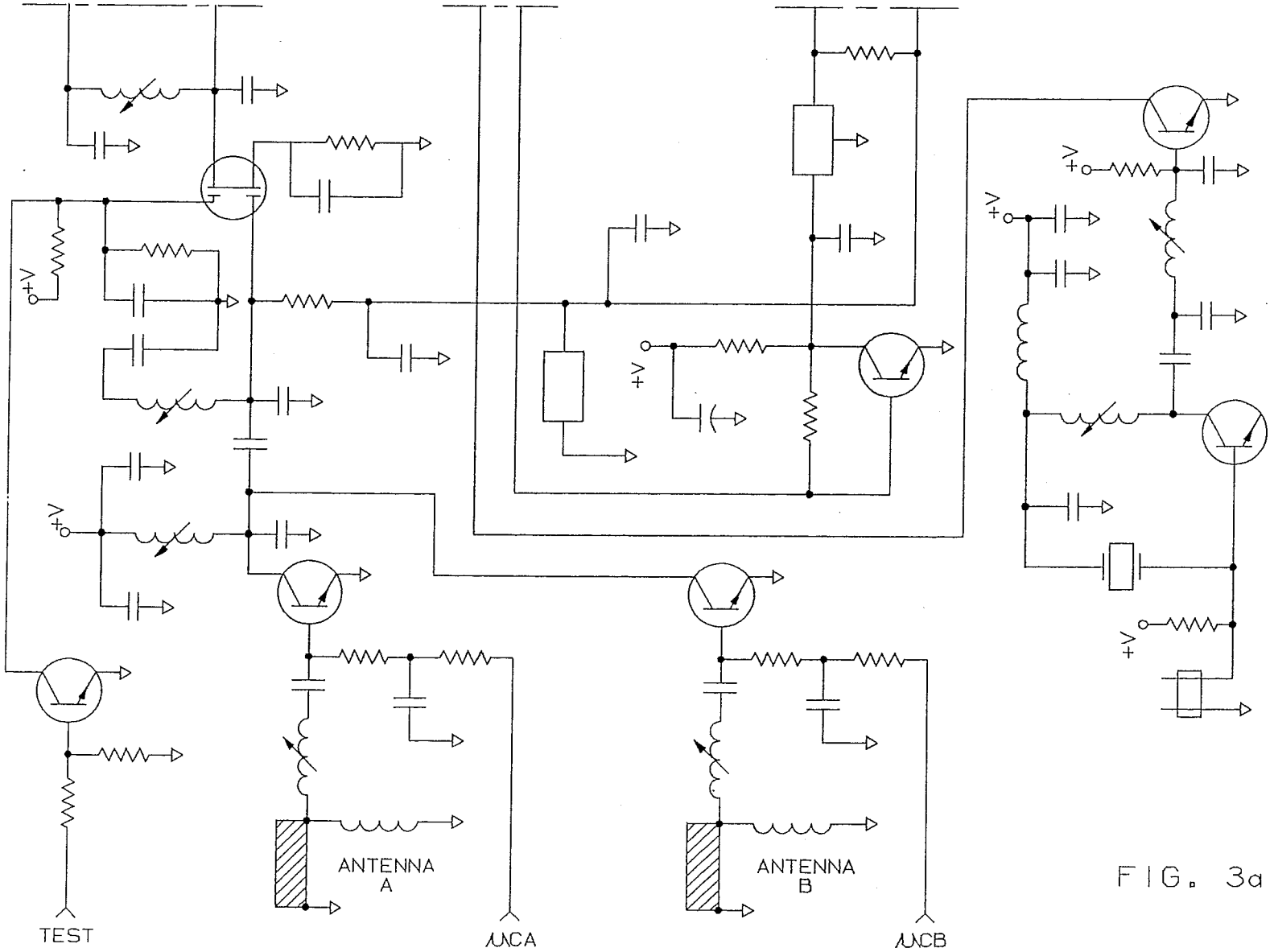
FIGS. 3*a* through 3*b*, shows a schematic diagram of the system controller's radio frequency communication's control circuitry.
Figure 3B:
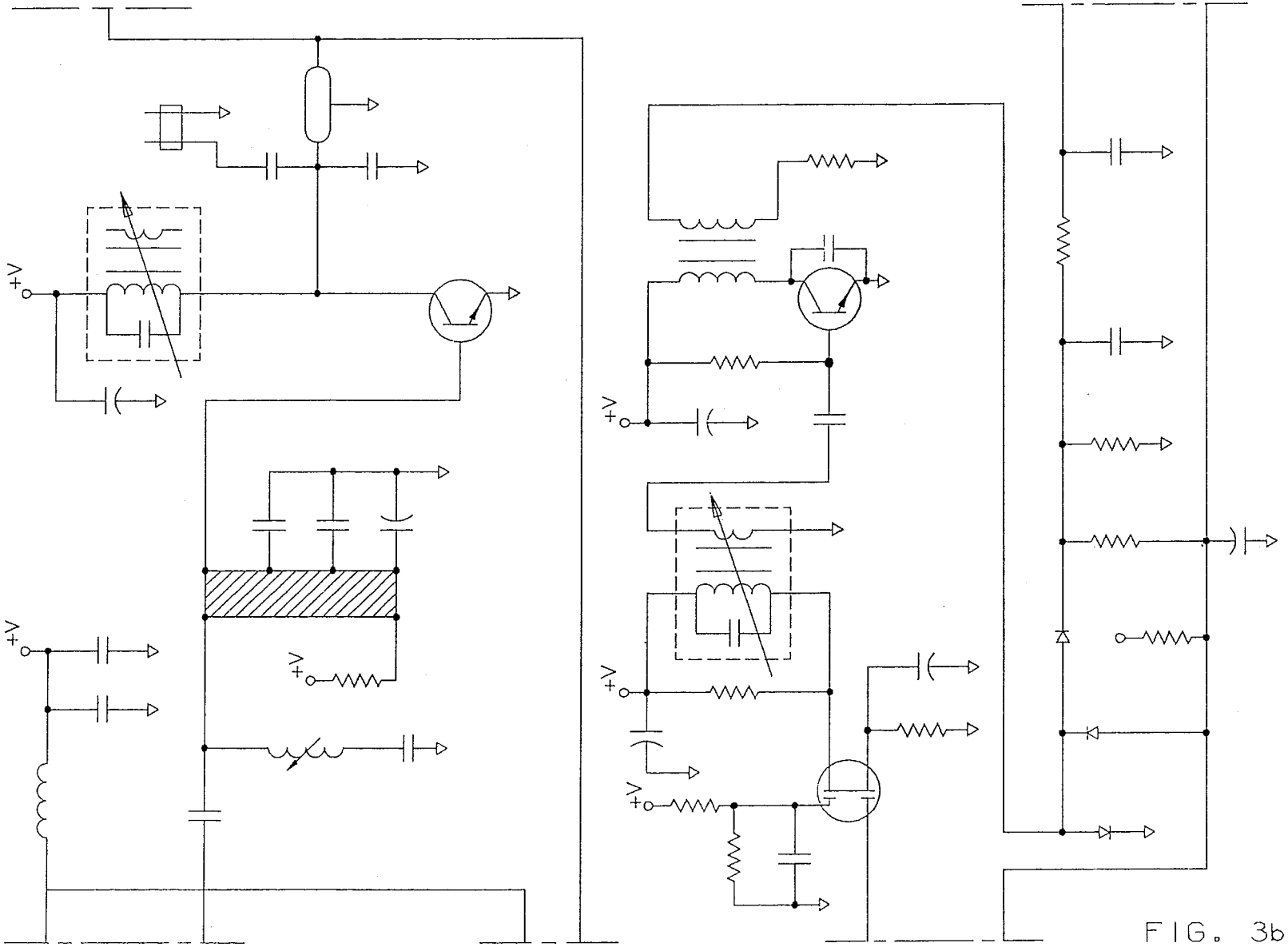
Figure 3C:
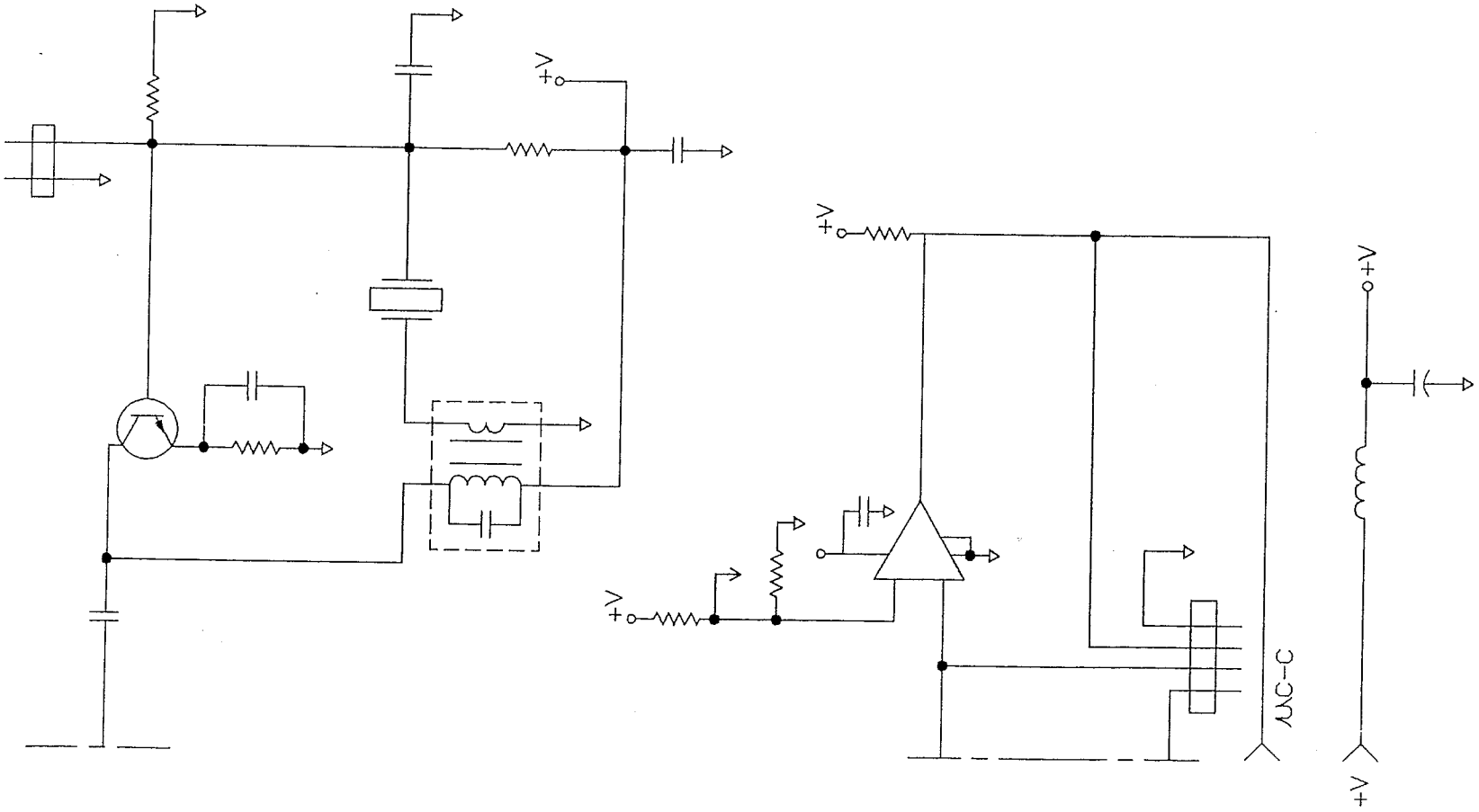
FIG. 3, including
Figure 4A:
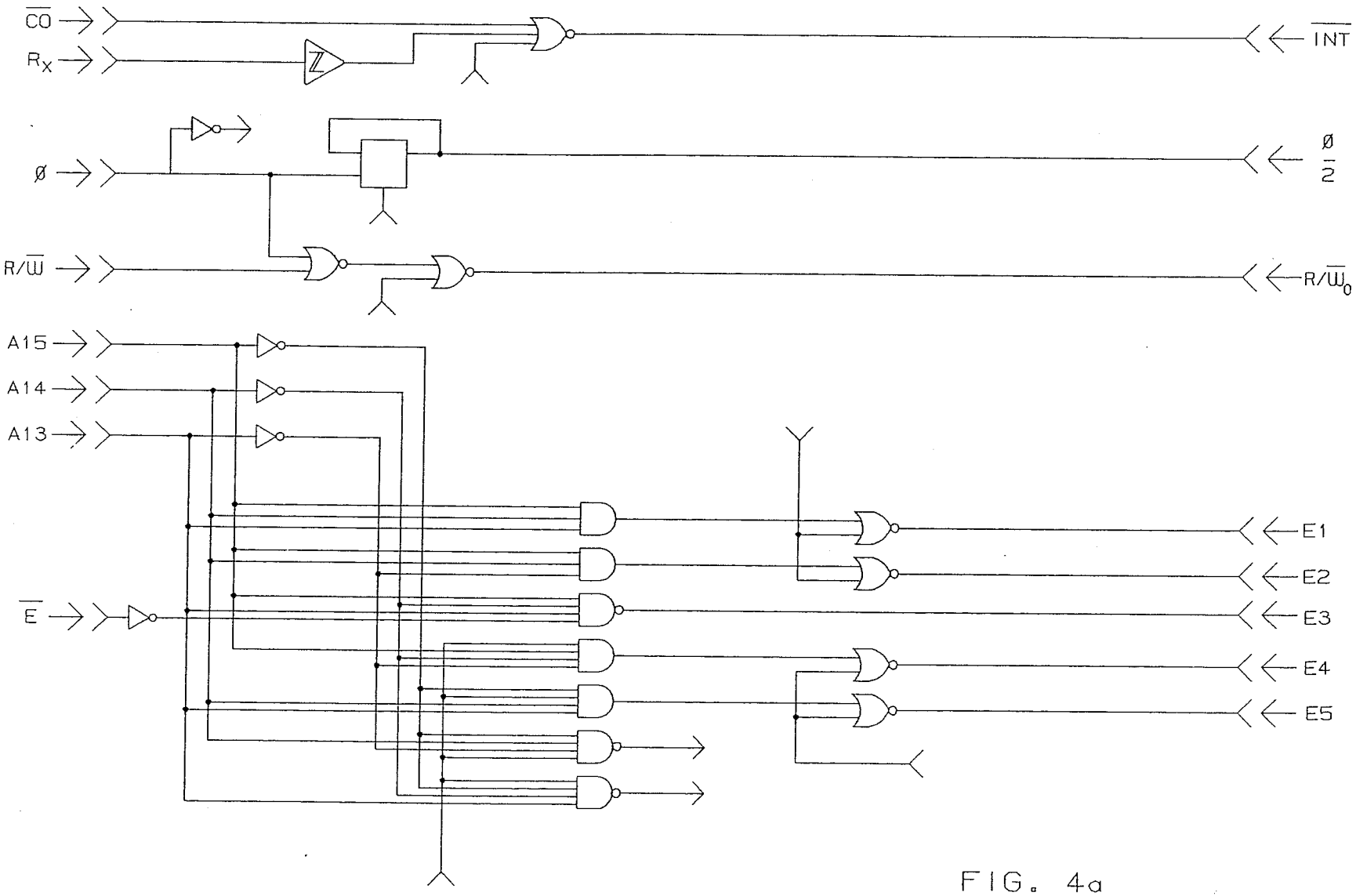
FIGS. 4*a* and 4*b* show a schematic diagram of the system's logic array for controlling input/output operations.
Figure 4B:
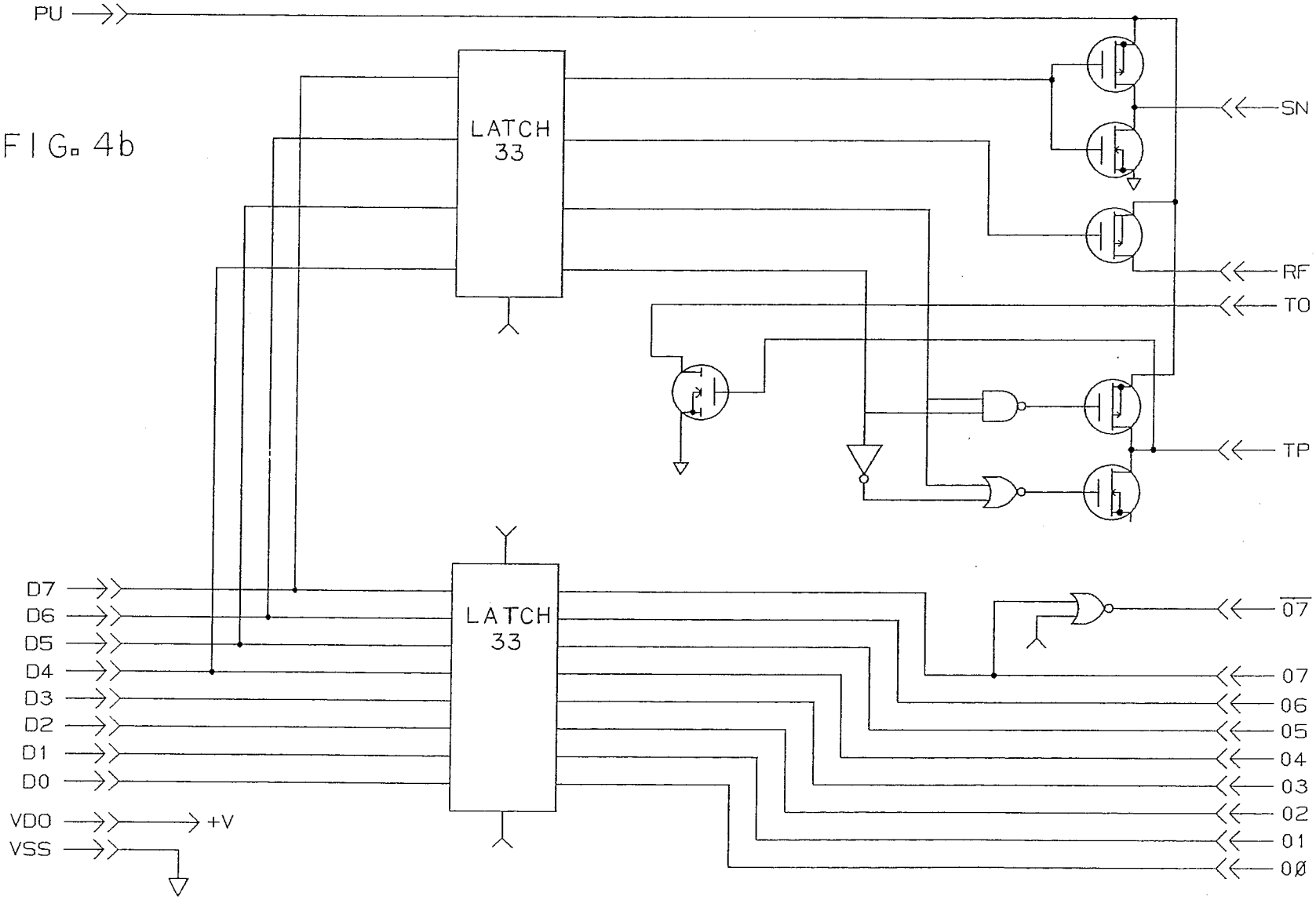

Whereas the Pinpoint and HIM circuitry enable hardwired communications with transducers T1 to TN, the sensors S1 through SN, transmit their status information to the controller SC1 by way of an RF communication link established between each sensor and the sensor transmitter receiver circuitry 32 (reference FIG. *2h*) which is shown in detail in FIG. 3 and FIGS. *3a* through *3c*. Although the detailed circuitry will not be described, the receiver 32 generally comprises a quartz crystal, double conversion, superhetrodine receiver having dual antennas. Dual switched antennas are used to improve the reception and although both may be included in each system controller cabinet, one may be remotely mounted at an elevated sight. The receiver frequency, typically 319.5 MHZ, is factory set and coincides with the transmission frequency of the sensors S1 through SN and the RF link RF1, which is the same for all sensors and all system controllers currently manufactured by Applicant.

Whereas, too, RF communications with the CPU 10 normally occur in only a receive mode; as mentioned, the CPU 10 in the event it is unable to access its phone lines may communicate with neighboring system controllers via the separate transmitter RF1 coupled to the "fail to communicate" driver circuitry and output terminal 34 (reference FIG. *2i*). In particular, a separate sensor transmitter, programmed with SC1's house code and the S/T identification number "00" typically performs this function. Alternatively, separate transmitters and receivers set to a different operating frequency from the sensors S1 to SN might be used. In either case, upon transmission of a "00" identification number, the programmed neighboring "buddy" systems, upon confirming receipt of a valid house code and the "00" transmission, switch into a "00" alarm condition and communicate the disabled system controller's account number and inability-to-communicate condition to the central station. More of the details of this operation will be described with reference to FIGS. 5 and 6.

Lastly, the separately mounted wireless key pad 13, or touch pad 12, coupled to key pad input terminal 36 and bus 8 (reference FIG. *2d*) permits the system user to control the operation of the CPU 10 and program various ingress and egress delay times, access codes, etc. Alternatively and as will be described in greater detail below, the user and/or installer may use the wireless key pad 13 or touch pad 12 and the controller SC1's internal programmer, upon placing the CPU 10 in a program mode, to program each of the sensors S1 through SN.

Turning attention to the types of output communications which might occur, other than the mentioned "buddy" communications, most commonly the controller SC1 communicates with the central station 4 by way of its dedicated phone link TL1 and the phone modes PMODE 0–4 of Table 9. Accordingly, phone line detect circuitry 35 is included for monitoring the condition of the phone line; a line seize relay 37 for seizing the phone line; a dial relay 39 for programmably dialing one or more programmable phone numbers and modem circuitry 40 for engaging in communications with the central station (reference FIGS. *2a* and *2d*).

Relative to the phone communication circuitry, the CPU 10, although providing a number of programmable connect options (e.g. S/T numbers 00, 83, 93, 97, F06 and F14) generally, upon seizing a phone line, attempts to communicate with the central station by way of programmed alternative phone numbers, a programmed number of times. If the CPU is unable to contact the central station, a fail to communicate or "96" condition is enabled which, if the transmitter RF1 is present at terminal 34, allows the CPU to contact the programmed neighboring system controller via a phone failure "00" transmission. Local annunciation may also be programmably enabled. Alternatively, if no phone line is detected, a "97" condition is enabled which also induces the CPU to transmit a "00" condition.

Appreciating the variety of functions performed by the CPU from providing a variety of annunciations to communicating with the central station or a neighboring system, a logic array 42 (reference FIG. *2h*) is provided intermediate the CPU 10 and various driver circuits to logically decode a variety of inputs and produce the desired responses and annunciations. A detailed schematic of the array circuitry is shown in FIGS. *4a* and *4b*.

Generally, though, the array 42, relative to the arming level, group number of a reporting sensor, alarm status and variously programmed options and parameters, logically decodes the parameters as it loads an internal latch 33. Ones of the latch outputs are further decoded and the resultant outputs are coupled to the driver circuits and the "fail-to-communicate" terminal 34, remote display terminal 44, carrier current terminal 46, interior siren terminal 48 and external siren terminal 50 (reference FIGS. *2f* and *2i*). Various of the other outputs of the array 42 operate to select and enable the phone line and/or a test output port (reference FIG. 2*h*).

Also coupled to the CPU 10 are a number of light emitting diodes (LED) 52 through 60 and alpha-numeric displays 62 and 64 (reference FIGS. 2*b* and 2*c*). The alpha-numeric displays 62 and 64 indicate the programmed arming level and sensor/transducer number and the LED's indicate sensor/transducer conditions, including each sensor/transducer's state or operation; that is, trouble, supervisory, alarm and bypass.

The "power" LED 60 reflects a steady glow, if the AC power is on, and flickers on and off, if the back-up battery source is supplying power; and is unlit, if the CPU is not receiving any power. Otherwise, the LEDs 52 through 58 are selectively lit by the CPU relative to each individually displayed sensor/transducer number at the display 64 during programming, re-programming alarm or status review, to identify whether the sensor is in an alarm condition, a supervisory condition, a low battery or trouble condition or in a bypass condition. The user or installer is thus able to directly view the condition of each distributed wireless sensor S1 to SN or hardwired transducer T1 to TN. For added convenience, the touchpad 12 includes a remote display (not shown) (reference FIG. 2*i*) to similarly display these conditions at a remote site.

Depending upon the controller's operating mode, the protection level display 62 normally displays a numeric arming level value from 0 through 9, during its armed mode, or the letter "P" during its programming mode. The programming mode is selected by way of the program switch 66 (reference FIG. 2*h*).

Two other provided selectable switches are a "fast forward" switch 68 and an "external memory" switch 70. These switches respectively permit the user/installer to scroll the displays 62, 64 at a faster pace when programming or reviewing the status of the installed sensors/transducers and notify the CPU of the existence of an external ROM 12. At present, ROM 12 is external to the CPU, although in the future it is contemplated the current ROM 12 contents will be included as part of the CPU's internal ROM, with the external ROM contents then facilitating controller enhancements, jump tables, etc. For example, future jump data might define the addresses of default data for a new function or the start address of a sub-routine of another loop. In any case, though, the installer without completely changing controllers is able to merely set switch 70 and replace ROM 12 to achieve an enhanced operation.

Before discussing a typical programming sequence and the manner in which the controller SC1 responds to the distributed sensors/transducers S1 through SN and T1 through TN, attention is directed to Table 1 below. Table 1 discloses a memory map of external RAM 14 wherein a variety of system unique, programmed values may be entered by the user/installer/central station. Each of these data entries are assigned an address location in memory under the listed names and functions and are selectively accessed by the CPU as it performs its primary loop and associated subroutines relative to the various detected inputs and pre-programmed controller responses.

TABLE 1

EXTERNAL RAM MEMORY MAP

| Name | Function |
|---|---|
| PHONEA | Phone number A |
| ACCT | Account code |

TABLE 1-continued

EXTERNAL RAM MEMORY MAP

| Name | Function |
|---|---|
| PHONEB | Phone number B |
| WCAR | Wait for carrier |
| WCATTA | Carrier attempts on A |
| ATTBFTC | Attempts on B, upper attempts before FTC |
| ATTMDE | Attempts before dialer mode change |
| REV | Type of system and revision |
| CHECK1 | Dailer checksum +1 |
| PACCES | Primary access code |
| AMBUSH | Ambush code |
| EETIME | Entry time |
| SRNDWN | Exit time |
| ARMDAT | Arming mode data |
| AMGD | Arming mode vs. group data table |
| CHNCNT | Channel control table |
| PSCHAN | Psuedo channels |
| CHECK2 | Panel control checksum +1 |
| PSCHAN2 | Psuedo channels |
| ID | System house code |
| SDRELD | Power out timer reload value |
| WEEKRP | Day weekly report occurs |
| LASTARM | Minutes, hours, days since last arming change |
| ADIAL | Automatic dial back to C.S. timer |
| BUDFLG | Buddy system flag register |
| DIALFLG | Dialer flags |
| RSFLG | Supervisory reset timer |
| BATTIME | Weekly battery test timer |
| POWFLG | AC poer failure flag |
| DAYCNT | Phone test 1-255 day cycle counter |
| DAYCNT1 | Phone test 1-255 reload register |
| SYSYNC | Supervisory hour timer |
| DAYREP | Daily report time (STIME) |
| SUPFRQ | Supervisory check frequency |
| PRVARM | Previous arming level |
| CRTARM | Current arming level |
| SDTIME | Arming mode 8 or 9 to 0 timer |
| SIRDOWN | Siren shutdown timer |
| JAM | |
| PLTIME | Blank display timer |
| BATTM | Audible low battery indication timer |
| CHNDAT 1 & 2 | Channel data (two bytes/channel) |
| DIALACT | Not used |
| CS | Check sum for transmit routine |
| BYTEC | Byte count for transmit routine |
| REPBUF | Report buffer |
| IDBCD | BCD system house code |
| USER | User number of last arming level change |
| ACSCNT | Access control bits for codes 3-10 |
| SACCES | Babysitter access code |
| ACCES2-10 | Access codes #2-#10 |
| ID1-4 | Buddy system house codes 1-4 |
| ACCT1-4 | Buddy system account numbers 1-4 |
| CHNSUPO | Supervisory timers for buddy system channel |
| CHNSUP | Supervisory timers channels 1-76 |
| EVTBUF | Event buffer |
| IDPNT | House code buffer pointer |
| IDBUF | House code buffer |
| REDD1 | Temp. storage in STPROG |
| ACCTREP | Account resent counter |
| COUNT | Bit time timer for port programming |
| TISP | Display scan pointer |
| LOOPCNT | Wait on line timer |
| GTENTO | Group 10 heard reset timer |
| PWRTBL | CPU low battery condition counter |
| AUTOMUT | Automatic dial back ×10 multiplier |
| TESTLTM | Reset timer for ZTESTL |
| KEYBUF | Touch pad input buffer |
| RESTM | Ram clear timer |
| EXTSA | External interrupt save reg. |
| CLOCK | Day-Month-Year-Time |

ROM 12, in turn, contains a plurality of power-up, system default values, such as the phone and account numbers, starting counts and times for various counting activities, system identification data, pseudo-channel data and access and ambush codes, among other data, which are written upon system initialization into various of the address locations of RAM 14 for later access by the CPU 10, along with user programmed/re-programmed data. Also included is interrupt vector address data which controls the timing of the CPU's operations. ROM 12 also includes current jump table data necessary for proper operation.

ROM 12 also contains a pre-assigned arming level versus sensor/transducer group data and sensor channel control data, which will also be discussed relative to Table 7 below. This data generally defines predetermined system responses for all the possible programmable S/T numbers, arming levels and groups of sensors/-transducers which share common features (e.g. police/emergency, auxiliary medical, fire, special, perimeter, interior delay/ndelay/2-trip or monitor).

The various bytes of data contain pre-set flags which are accessed by the CPU 10. Each S/T number and arming level is assigned an individual byte of channel control data and each arming level versus sensor/transducer group are written into a 10 by 16 tabular matrix and the programmable S/T numbers are listed in relation to particular channel control data. As alarm, supervisory, buddy and restore events, among others, are later detected and the reporting sensors/transducers are identified and grouped, the system controller's response is thus defined for each of the possible arming levels relative to the types and groupings of the of reporting sensors/transducers, with the exception of the variously programmed options and features entered in RAM 14. More of the details of these responses and the byte make-up of the channel control flags assigned to the grouped sensors/transducers will however be discussed with respect to Table 7.

Otherwise and referring to Tables 2 and 3 below, the CPU 10 as it performs its primary loop appropriately accesses the various subroutines of Table 2 using the data and microcoding of Table 3 programmed into the CPU's internal RAM, along with the contents of RAM 14. Which subroutines are performed depends upon detected flag conditions as each of the wireless sensors S1 through SN and hardwired transducers T1 through TN report or respond to alarm events and as the various counters, buffer registers and working registers in the CPU 10 respond to the data stored in the CPU's internal RAM and RAM 14.

TABLE 2

SUBROUTINE LIST

| File Name | Function |
|---|---|
| JUMP.OBJ | Jump Table |
| INIT.OBJ | Power Up |
| MAIN.OBJ | Main Loop |
| ALARM.OBJ | Alarm Processor |
| DSPLY.OBJ | Display |
| EIGHT.OBJ | Key pad |
| SUPER.OBJ | Supervisory |
| CHECK.OBJ | Check Sum |
| RFDATA.OBJ | RF Checking |
| INTRP.OBJ | 1 Millisecond Interrupt |
| RFTIME.OBJ | 100 Millisecond Interrupt |
| COMMAIN.OBJ | Phone Communications |
| TRANS.OBJ | Phone Communications |
| FSKRT.OBJ | Phone Communications |
| EXTERN12.OBJ | External interrupt |
| BUFFERS.OBJ | Event/Alarm Buffer |
| STPROG.OBJ | Program Sensor |
| POWER.OBJ | Power Values |

Depending upon the initiating event and the internal branching which occurs within any initiated subroutine, various ones of the functional routines are accessed. They in turn, for example, assure that received sensor/-transducer, wireless key pad, touch pad, central station or neighboring system data is valid (i.e. that it exhibits the proper format, house code, unit number and S/T number and sensor type; initiate the appropriate alarms and display operations relative to the detected S/T number and grouping, feature numbers and arming level in the tabular listings in RAM 14; log reported events into a controller event buffer; sieze and control phone communications to report the data loaded into the alarm buffer; initiate proper local annunciations; and perform necessary error checking, among various other functions.

Instead of individually describing the sub-routines of Table 3, it is to be appreciated the system controller SC1, although configured differently from Applicant's Model SX-IVB alarm system, performs many of the same functions, along with a number of new and improved functions. Accordingly, a detailed description is not provided of each function, although the general nature of many of which will be apparent from Tables 4 and 5 below. For the interested reader, the flow chart listings of the alarm processing subroutine and event/alarm buffer entry sub-routines are appended hereto as Tables 11 and 12. Rather, greater attention is directed to those particular new and improved functions which are claimed hereinafter.

TABLE 3

CPU RAM MEMORY MAP

| File Name | Description |
|---|---|
| ZRFSFTA | Input data shift registers - RF receiver data |
| ZRFSFTB | Input data shift registers - hardwire touch pad data |
| ZRFBUFA | RF message buffer A |
| ZRFBUFB | Hardwire input message buffer |
| ZRFBUF | RF message buffer - next data |
| ZFCA | RF frame counter |

| | |
|---|---|
| ZMSCNTA | Millisecond count within frames |
| ZBITCNT | Position of RF pulse in frame |
| ZISPTA | Input start pulse timer for RF receiver A |
| ZBCA | Bit count for RF timer interrupt part A |
| ZSCA | Sample count for RF timer interrupt part A |
| ZSCAA | Sample count storage for RF timer interrupt part A |
| ZCCB | Compares counter for hardwire touch pad |
| ZMSCNTB | Millisecond count within frames for receiver B |
| ZIMPTB | Inter-message timer for receiver B |
| ZRFFLG1 | Misc. RF Flags #1 |

| BIT | FUNCTION |
|---|---|
| 0 | Stop antenna switching flag |
| 1 | Current antenna |
| 2 | |
| 3 | Data received in frame flag |
| 4 | RF data ready flag |
| 5 | In 1 mS interrupt flag |
| 6 | Modulation bit for external siren |
| 7 | Looking for start pulse flag |

ZRFFLG2 Misc. RF Flags #2

| BIT | FUNCTION |
|---|---|
| 0 | Data ready for RFDATA routine |
| 1 | Data ready from RF receiver |
| 2 | Data ready from hardwire input |
| 3 | Last data flag 1 = RF; 0 = hardwire touch pad |
| 4 | Current state of AC input |
| 5 | Looking for AC transition flag |
| 6 | Carrier current data ready flag |
| 7 | Send carrier current data flag |

| | |
|---|---|
| ZRJAM | Receiver Jam timer |
| ZCCTIME | Carrier current output timer |
| ZACOUNT | Access code attempt counter |
| ZATRT | Access code attempt counter reset timer |
| ZTRBLE | Trouble beep timer |
| ZTBKC | Time between keystrokes counter |
| ZTMER | Pinpoint initiation timer |
| ZPINNUM | Pinpoint sensor number |
| ZPINDAT | Pinpoint sensor data |
| ZYSAVE | Save Y register in buffers routines |
| ZSTROKE | Stroke count storage |
| ZRTCD | Real time counter - time of day |
| ZRTS | Real time counter - storage register |
| ZRTFLG | Real time flag register |

| BIT | FUNCTION |
|---|---|
| 0 | No AC power flag 1 = no AC power |
| 1 | Alarm occurred flag |
| 2 | Trouble beep |
| 3 | Arming level change - event buffer |
| 4 | One hour up flag |
| 5 | One minute up flag |
| 6 | 24 hours up flag |
| 7 | 2 mS read for time keeping |

| | |
|---|---|
| ZACOUT | Timeout before setting AC power failure flag |
| ZP4BUF | Port P4 output buffer |
| ZPEBUF | External port output buffer |
| ZP6BUF | Port P6 output buffer |
| ZOUTBUF | Seven segment output bufffer and discrete LED's output buffer |
| ZREMSHT | Remote display shift register |
| ZREMOUT | Remote display output shift register |
| ZTIME1 | 1 second display up-date timer |
| ZCCND | Current channel number in display |
| ZSCNTME | Scan timer |
| ZTEST | Jam display in test mode |
| ZTESTL | Last sensor tested |
| ZLLSSC | Low level siren shift counter |
| ZTIME2 | Entry/Exit timer |
| ZCCSBUF | Carrier current shift buffer |
| ZSBFLG | Audible low battery and super indication flags |

| BIT | FUNCTION |
|---|---|
| 0 | Supervisory occurred flag |
| 1 | Low battery occurred flag |
| 2 | Low battery has existed for 4 days flag |
| 3-7 | Not used |

| | |
|---|---|
| ZCCSFT | Carrier current shift register |
| ZSUPTM | Audible supervisory indication timer |
| ZSRNCNT | Siren control register |

| BIT | FUNCTION |
|---|---|
| 0 | Interior shift once |
| 1 | Interior shift continuous |
| 2 | Short low level (chime) |
| 3 | Short high level (test mode) |
| 4 | High level continuous (fire) |
| 5 | High level modulated (burglary) |
| 6 | Low level (auxiliary and error) |
| 7 | Arming rejection |

| | |
|---|---|
| ZSRNDLY | External siren delay timer |
| ZAMDATA | Arming mode data |
| ZAMVSGD | Arming mode vs. group data |
| ZCHNIN | Group number of channel input and checksum totaling |
| ZCHNREC | Channel value received |
| ZDATREC | Data received flags |

| BIT | FUNCTION |
|---|---|
| 0 | Battery or tamper flag |
| 1 | Channel status flag |
| 2 | Alarm flag |
| 3 | Process immediately flag |
| 4 | Type flag 1 = pinpoint; 0 = RF |
| 5-7 | Not used |

| | |
|---|---|
| ZGTENNM | Last group 10 sensor number received |
| ZGTENTM | Time before resetting ZGTENNM timer |
| ZARMTMP | Arming level being attempted |
| ZTACNT | Alarm counter for tamper input |
| ZPRGFLG | Programming mode flag register flag which cause main loop of initialize unit flag of 2nd byte channel data |

| | |
|---|---|
| ZPPORT | Programming port data |
| ZTIME5 | 5 second timer forces display from ZPINBUF |
| ZPINBUF | Program input buffer sensor and to be initialized |
| ZMLTIME | Main loop timer |
| ZMIN1 | Minutes divider #1 |
| ZINVLD | Invalid sensor number heard storage |
| ZTEMP1,6,7 | Misc. panel routine data |
| ZMFLAG1 | Misc. flag register for panel routine |

| BIT | FUNCTION |
|---|---|
| 0 | Phone line under test |
| 1 | Waiting for bypass key entry |
| 2 | Entry delay active |
| 3 | Exit delay active |
| 4 | Access granted (primary) |
| 5 | Ambush requested |
| 6 | Access granted (secondary) |
| 7 | Arming mode rejected, request bypassing |

ZMFLAG2 Misc. flag register for panel routine

| BIT | FUNCTION |
|---|---|
| 0 | Power up okay |
| 1 | Power up checksum fault (write system ID |
| 2 | Checksum error flag |
| 3 | Divide 2 flag for exit/entry |
| 4 | Power up, calculate checksum |
| 5 | Display alarm history |
| 6 | Supervisory routine |
| 7 | Dash inhibitor used in display routine |

ZMFLAG3 Misc. flag register for panel routine

| BIT | FUNCTION |
|---|---|
| 0 | 0 = return to comm; 1 = return to panel |
| 1 | 0 = no phone report needed; 1 = phone report needed |
| 2 | 0 = no sensor heard from; 1 = sensor heard from. |
| 3 | 0 = program o.t.; 1 = program sensor |
| 4 | 1 = heard from group 10 |
| 5 | Pinpoint data minder: 1 = data not taken care of |
| 6 | Pinpoint data error: 1 = same data from pinpoint |
| 7 | 0 = not time for main loop; 1 = time for main loop |

| | |
|---|---|
| ZTEMP3-6 | Misc. use in communicator |
| ZATTA | Attempts on line A counter |
| ZATTB | Attempts on line B counter |
| ZDLFLG | Dialer flag register |

| BIT | FUNCTION |
|---|---|
| 0 | 0 = dial phone #A; 1 =dial phone #B |
| 1 | 1 = security code received |
| 2 | 0 = V record; 1 = M record |
| 3 | 1 = bypass report |

| | | |
|---|---|---|
| | 4 | 1 = carrier received |
| | 5 | not used |
| | 6 | 1 = special report |
| | 7 | 1 = 15 min. audio wait enabled |

ZMODREG Mode register

ZTONE Next tone to send

ZBTIME Baud rate timer

ZFSKFLG Transmit routine flags

| BIT | FUNCTION |
|---|---|
| 0 | Parity minder for transmit routine |
| 1 | Byte count sent flag |
| 2 | Checksum sent flag |
| 3 | not used |
| 4 | not used |
| 5 | not used |
| 6 | Data ready to send flag |
| 7 | Transmit enable flag |

ZMEMADR Memory address reg. used in memory read or write from CS

ZCARMND Carrier minder during receive

ZRBAUD Baud rate timer for receive

ZBCOUNT Number of bytes in FSK transmit/receive buffer

ZMFLAGC Receive routine flags (communicator)

| BIT | FUNCTION |
|---|---|
| 0 | 1 = carrier receive routine; 0 = data receive routine |
| 1 | Start bit received flag |
| 2 | Carrier detected flag |
| 3 | Parity minder in receive routine |
| 4 | Parity okay flag |
| 5 | Receive enable |
| 6 | not used |
| 7 | Time to sample flag |

ZFSKBUF Sample results for FSK decode

ZMODBUF FSK transmit/receive buffer (21 bytes)

ZEVNTPT Pointer to event buffer

ZPBUFPT Panel pointer to alarm buffer

ZCBUFPT Communicator pointer to alarm buffer

ZBUFPT Communicator working pointer to alarm buffer

ZEBUFPT End of buffer pointer to alarm panel

ZSTPNT1 Stack pointer #1

ZSTPNT2 Stack pointer #2

**********

JUMP TABLE

ZCSP Checksum program in panel

ZMAINP Main program in panel

ZEIGHT Eight program

ZRF RF data program

ZRESET Reset Program

ZDSPLY Display program

ZALARM Alarm program

ZNEXAM Enter next arming mode routine

ZARM Arming routine

```
ZS24          S24 routine
ZSUPER        Supervisory routine
ZCCRNT        Carrier current output loading subroutine
ZTINT1        Timer interrupt # 1
ZTINT2        Timer interrupt # 2
ZTIMEX        Timer x interrupt
ZEXT2         Ext. interrupt # 2
ZEXT1         Ext. interrupt # 1
ZTRANS1       Transmit program in communicator
ZFSKCR        FSK carrier detect program in communicator
ZMAINC        Main program in communicator
ZABUF         Alarm buffer fill routine
ZEBUF         Event buffer fill routine
ZSENSOR       Sensor routine
ZTRNPGM       Transmitter programming routine

*************************************************************

                PORTS/REGISTERS/TIMERS

ZPORTO        Port PO
ZDDRO         Port PO data direction register
ZPORT1        Port P1
ZDDR1         Port P1 data direction register
ZPORT2        Port P2
ZDDR2         Port P2 data direction register
ZPORT3        Port P3
ZDDR3         Port P3 data direction register
ZPORT4        Port P4
ZDDR4         Port P4 data direction register
ZPORT5        Port P5
ZPORT6        Port P6
ZTRMODE       Transmit/receive mode register
ZTRCNT        Transmit/receive control register
ZTRANS        Transmit register
ZRECBUF       Receive register
ZT12PRE       Timer 1 and 2 pre-scaler
ZTMER1        Timer 1
ZTMER2        Timer 2
ZTXPRE        Timer X pre-scaler
ZTMERX        Timer X
ZINTCNT       Interrupt control register
ZTIMCNT       Timer control register
```

PROGRAMMING

As noted, each system controller SC1 to SCN is programmable with a variety of data, including the sensor/tranducer (S/T) numbers, options and features, which are shown in Tables 4 and 5 below. Programming may also be effected in a variety of fashions and whereby maximum flexibility is obtained for the user-/installer/central station, during initial system setup and/or during later reprogramming.

In particular, each of the RF or wireless sensors S1 to SN may be separately programmed with the aid of the hand-held programmer 11. The sensors, along with the hardwire transducers, may then be separately programmed into the controller via the wireless key pad 13. Alternatively, each controller SCl to SCN, with a few exceptions, may be programmed with its assigned S/T numbers from the central station 4. Additionally, where the controller has an internal programmer, the sensors transducers, Pinpoint and HIM modules, and CPU 10 may be prrogrammed at the same time upon separately coupling each sensor to the programming connector 26 and entering the appropriate programming data via the wireless key pad 13 or touch pad 12.

Even further and without human intervention, once the sensors transducers are initially programmed, each system controller may be operated to "self-learn" each of its sensors. In this mode as the sensors/transducers report to the controller for the first time and after the controller confirms the existence of a proper house code or unit number, they are logged into the controller's RAM memory. Human error is thus minimized even though during hand programming with the wireless key pad 13, the circuitry performs a similar subroutine to log the assigned S/T numbers into RAM.

Figure 6:
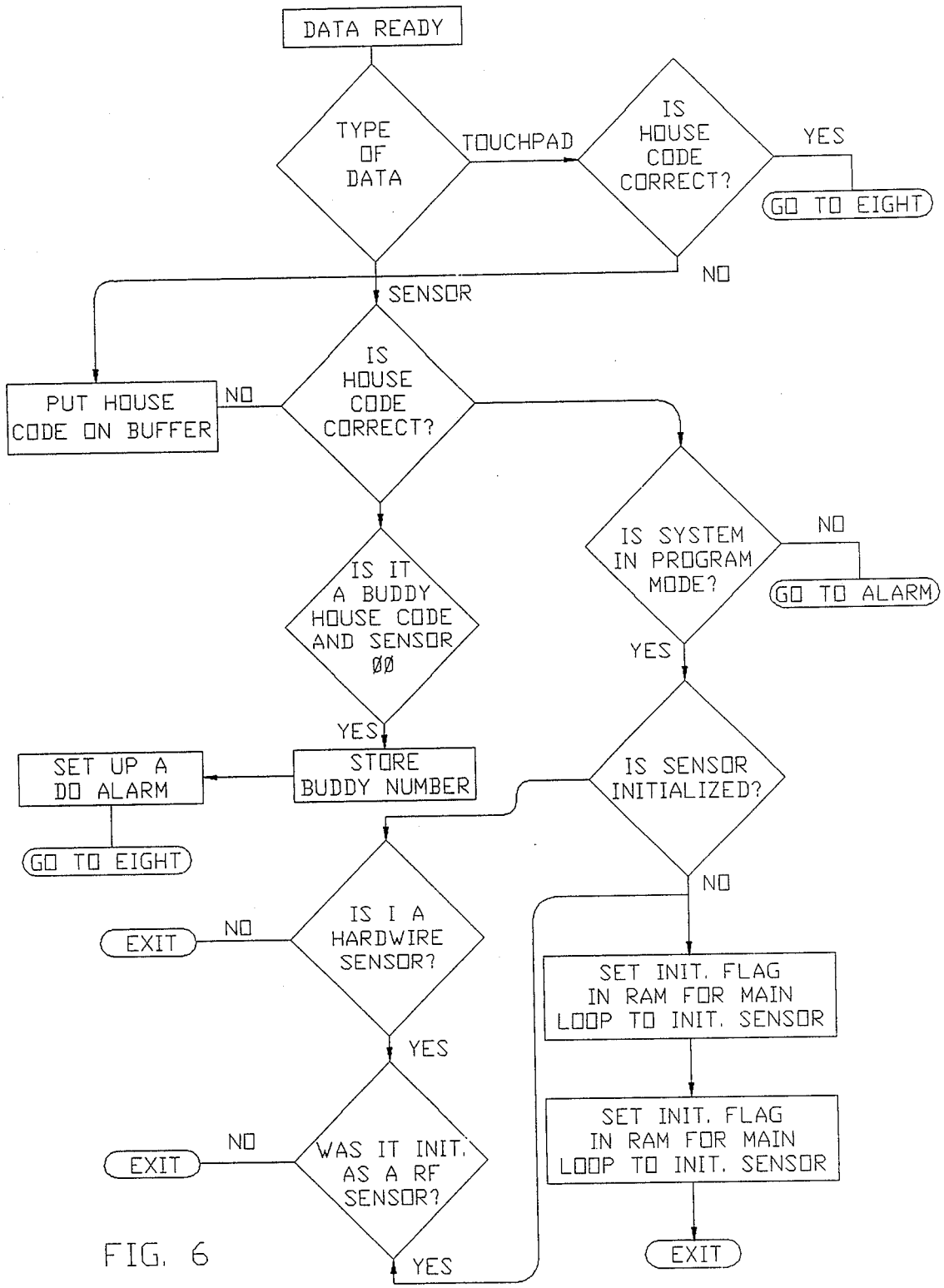
FIG. 6 shows a flow chart of the CPU's operation relative to a buddy system alarm and the initialization or self-learning of each sensor/transducer number.

With particular attention directed to FIG. 6, a flow diagram is shown of the CPU's operation during system initialization as well as during a neighboring systems inability-to-communicate or "00" phone failure alarm transmission. Picking up at the point in FIG. 6 where the controller confirms that a received house code corresponds to one in its memory, the CPU next checks to see if it is in a program mode; if not, the alarm subroutine is accessed. If it is in a program mode and the sensor was previously initialized, the CPU checks to see if the sensor is either a hardwired or an RF sensor. Presuming the sensor corresponds to one of the possible types, the CPU exits the subroutine. Alternatively, if the sensor was not previously initialized, the CPU sets a flag in the file "ZPINBUF" (reference Table 3) which causes itself to later initialize the appropriate S/T number into internal RAM. That is during the next main loop, the CPU flags the address including the appropriate S/T number from 00 to 97 so that during future reports it will know it to be one of its transducers. If the reporting sensor/-transducer was a hardwire transducer, the transducer's unit number is also stored and a hardwire flag is set. Alternatively, an RF flag is set to identify a wireless sensor.

In the later regard, it is to be noted the S/T numbers may be assigned to any of the RF or hardwire tranducers. Similarly, although the S/T numbers are preassigned to specific group types (reference Table 6) the S/T numbers may be reassigned by the central station to accommodate system needs and in which event the controller will respond per the new group assignment. Upon next reporting to the CPU and detecting the set program/nprogram mode and hardwire/RF flags, the CPU exits the routine or goes to the alarm routine. Most importantly, however, the controller teaches itself the identity of its reporting sensors without operator intervention.

In the above regard and during system initialization, the installer at his/her shop typically develops a tabular listing of each of the S/T numbers to be assigned to the various sensors and transducers to be placed about the subscriber premises. The preconditioning parameters of each sensor are also defined, if different from those normally set by the system, such as the NO/NC transducer state, restore, lockout delay or other parameters which are separately programmable for each RF sensor. The installer then separately programs each sensor with this data via the hand held programmer 11.

Upon later mounting the sensors and controller at the subscriber premises, the controller is enabled and self-learns each of its sensors/transducers as they report their status. At that time, the controller is also programmed for those various optional sensor numbers, system features, entry and exit delay times, access and duress codes, account numbers, phone numbers and real time clock data, among other programmable data, which have been determined to be necessary for proper system operation. At the same time, the installer may bypass ones of the pre-programmed S/T numbers, if they are not initially required. Installation time is thereby reduced with minimal potential installer error, due to the CPU self-learning its reporting sensors.

PROGRAMMABLE S/T NUMBERS

Turning particular attention to Tables 4 and 5 below, a listing is shown of each of the present system's possible programmable S/T numbers. Which numbers are assigned to which sensor/transducers depends upon the subscriber's needs. Generally though the subject controller provides for ninety-eight programmable sensor identification numbers, along with sixteen optional feature members. The available sensor numbers accommodate in excess of eighty zones with some sixteen groupings of annunciation or systen response for ten programmable arming levels and whereby regardless the wireless sensor or hardwired transducer transducer type a similar system response is produced. The latter sensor groupings are shown in Table 6 below.

The bulk of the available sensor numbers are particularly allotted to twenty-four hour emergency zones (i.e. 02–07, 10–17 and 20–27), special and exterior intrusion sensors (i.e. 30–37) and interior intrusion sensors (i.e. 40–57, 60–67 and 70–76). Of the available pre-programmed sensor numbers, sensors 80–82 provide for remote emergency buttons at wireless key pad 13 or touchpad 12.

Sensor 86 provides for a special "duress" code that silently transmits an immediate emergency call without displaying the conditions at the controller, thus a user forced under duress to disarm the system might enter this code to contact the police without alerting the intruder. Sensor 96, in turn, corresponds to a "fail-to-communicate" condition which occurs where the controller is unable to contact the central station in three attempts. Additionally, it is to be noted all of the sensors are supervised, except for sensors 2–5 and 10 and 11, and periodically report their status and battery condition to the controller.

A variety of optional sensor numbers are also provided (e.g. 00, 77, 84–87, 90, 93 and 97) and of which sensor numbers 00 and 97 correspond respectively to "phone failure" and "no phone line" conditions. Of these, if a violation of sensors 02–82, 86 or 92 occurs and the controller is unable to access the phone lines or a "96" condition occurs, the CPU induces the "00" or phone failure transmission to any neighboring buddy controllers. A buddy controller then reports the malfunctioning system's condition to the central station 4.

Figure 5:
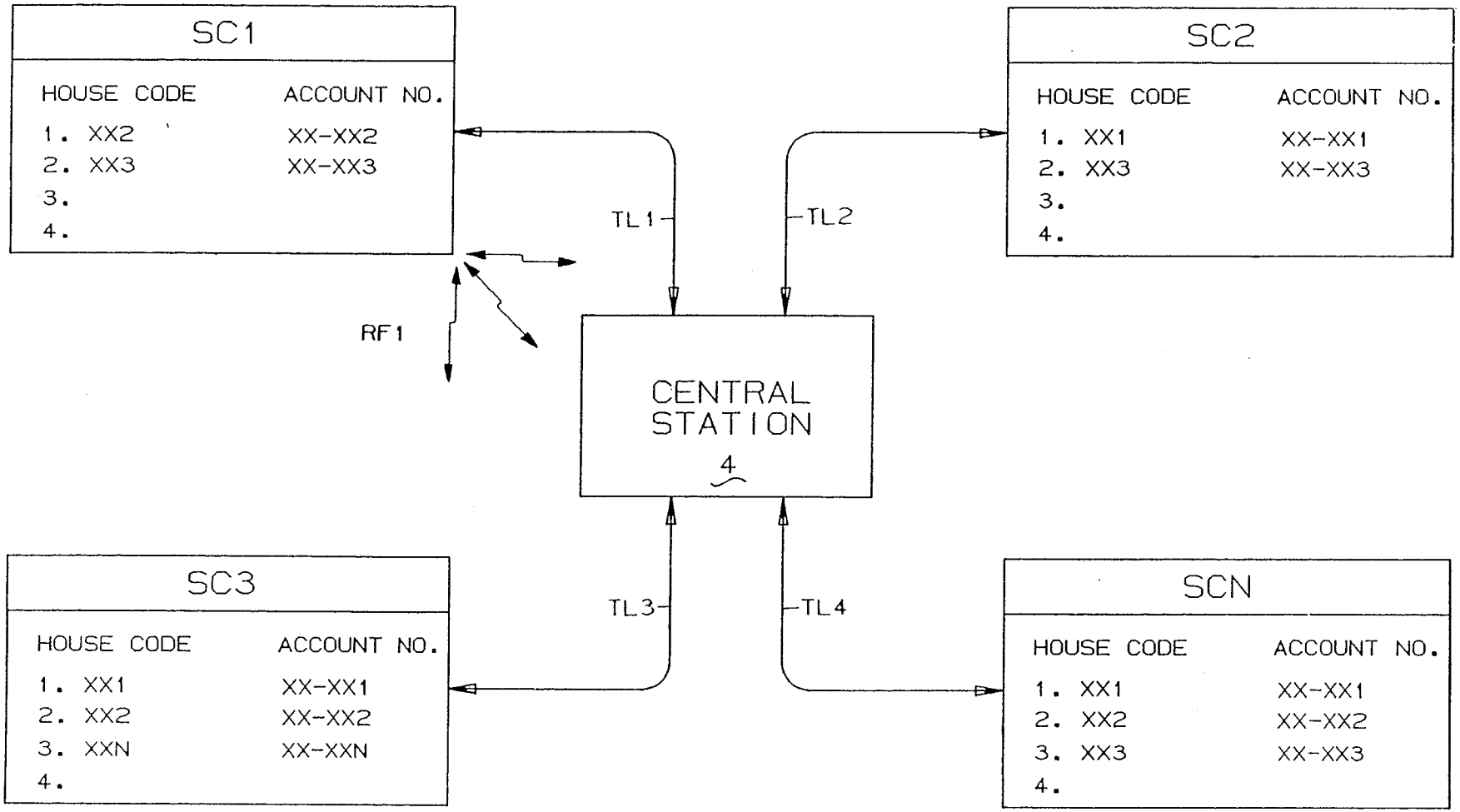
FIG. 5 shows a generalized diagram of the operation of the "buddy" communications.

In that regard and with attention directed to FIGS. 5 and 6, a general block diagram is shown of a number of subscriber controllers coupled to the central station 4 and a flow chart of each controllers operation during a "00" or phone failure transmission. Assuming each of the neighboring controllers SC1 to SCN includes a receiver tuned to one of its neighbors, and each is programmed with the house code and account number of any of four of its neighbors within its RAM 14. Any neighboring controller upon detecting a "00" phone failure condition and a house code within its buddy memory will responsively load the account number of its malfunctioning neighbor into its alarm buffer and initiates a "00" alarm, wherein it transmits the "00" alarm and its neighbor's account number to the central station 4 for appropriate action. Consequently, each controller configured and programmed for buddy operation is assured during an alarm violation of sensor numbers 02–82, 86 and 92 that the central station will be made aware of the inoperability of its phone lines and not be cut off from communications with the outside world.

TABLE 4

| S/T Number | Active Arming Levels | Siren Sound | SENSOR NUMBERS Description |
|---|---|---|---|
| 02–03 | 0–8 | POLICE | 24 HOUR POLICE EMERGENCY-AUDIBLE-UNSUPERVISED For use with unsupervised Portable Panic Buttons. |
| 04–05 | 0–8 | NONE | 24 HOUR POLICE EMERGENCY-SILENT-UNSUPERVISED For use with supervised Portable Panic Buttons. |
| 06 | 0–8 | POLICE | 24 HOUR POLICE EMERGENCY-AUDIBLE-SUPERVISED For use with regular transmitters wired to a panic or medical button. |
| 07 | 0–8 | NONE | 24 HOUR POLICE EMERGENCY-SILENT-SUPERVISED For use with regular transmitters wired to a panic or medical button. |
| 10–11 | 0–8 | AUXIL. | 24 HOUR MEDICAL EMERGENCY-UNSUPERVISED For use with an portable panic button. NOTE: Central Station operator must use GROUP command to re-program zones to make them supervised if you plan to use fixed panic button wired to supervised transmitter. |
| 12–17 | 0–8 | AUXIL. | 24 HOUR ENVIRONMENTAL-SUPERVISED For furnace failure, flood, freeze, power failure, etc. |
| 20–27 | 0–8 | FIRE | 24 HOUR FIRE SENSORS |
| 30–33 | 1–7 | POLICE | SPECIAL INTRUSION For special belongings such as Silent in Level 5. |
| 34–37 | 3–7 | POLICE | EXTERIOR DELAYED INTRUSION-SUPERVISED For delayed entrance doors. Chime in Level 2, Instant in 7, Silent in Level 5. Disarmed during Entry/Exit delay. Causes the CPU to start entry delay sequence. |
| 40–49 50–57 | 4–7 | POLICE | INTERIOR INTRUSION-MOMENTARY DEVICES For motion sensors, mats, sound sensors, etc. Disarmed during entry/exit time delay. Silent in Level 5, Instant in Level 7. |
| 60–63 | 4–7 | POLICE | INTERIOR INTRUSION-MOMENTARY DEVICES For Motion Sensors, Mats, Sound Sensors, etc. Disarmed during entry/exit time delay. Silent in Level 5, Instant in Level 7. |
| 64–65 | 4–5 | POLICE | INTERIOR INTRUSION-MOMENTARY DEVICES Same characteristics as 60–63 except disarmed in Levels 6 & 7. Typically used for sensors that are in the bedroom area that must be off all night. |
| 66–67 | 4–5 | POLICE | INTERIOR DELAYED INTRUSION-MOMENTARY DEVICES Same characteristics as 64–65 except sensors programmed to these numbers WILL INITIATE AN ENTRY AND EXIT DELAY just like an entry door. This will give customer who forgets to disarm his system before entering a protected interior area time to disarm system before it goes into alarm. |

TABLE 4-continued

| | | | |
|---|---|---|---|
| 70–72 | 4–7 | POLICE | INTERIOR INTRUSION-INTERIOR DOORS For interior doors, cabinets, wall safes, jewelry boxes and anything else that opens and closes. Disarmed during entry/exit time delay. Silent in Level 5, instant in Level 7. |
| 73–74 | 4–5 | POLICE | INTERIOR INTRUSION-INTERIOR DOORS Same characteristics as 70–72 except disarmed in Levels 6 & 7. Typically used for doors and cabinets in bedroom area that must be off at night. |
| 75–76 | 4–5 | POLICE | INTERIOR INTRUSION-INTERIOR DOORS Same characteristics as 73–74 except sensors programmed to these numbers WILL INITIATE AN ENTRY AND EXIT DELAY when tripped just like an entry door. This provides the subscriber who forgets to disarm his system before entering a protected interior area time to disarm the system before it goes into alarm. |

PRE-PROGRAMMED SENSOR NUMBERS

| Sensor Number | Active Levels | Description |
|---|---|---|
| 01 | 0–8 | SYSTEM INTERFERENCE - If the CPU hears a transmitter with the correct House Code, but an invalid S/T number for its system program, (i.e. a number not stored in its memory) it silently reports 01 BAD SENSOR NUMBER and the number of the invalid snesor to the Central Station. The CPU displays 01 ALARM locally. This determines whether the House Code selected is available or if an alternative should be chosen. |
| 80 | 0–8 | 24-HOUR FIRE CALL from a Wireless Touchpad. Audible. |
| 81 | 0–8 | 24-HOUR POLICE CALL from a Wireless Touchpad. Audible. |
| 82 | 0–8 | 24-HOUR AUXILIARY CALL from a Wireless Touchpad. Audible. |
| 83 | 8 | PHONE TEST initiated by customer. After a successful test, all sirens sound briefly at the site or the Central Station operator calls. 83 clears from display and CPU returns to Level 0. |
| 86 | 0–9 | DURESS CODE. Special access code that silently sends a 24 hour POLICE EMERGENCY CALL to the Central Station. The Duress Code must be followed by any protection level. Sensor number does not display, only reports. Even though sensor number 86 is pre-programmed, it will not report unless the installer has entered a duress code. |
| 91 | 0–9 | LOW CPU BATTERY. After this report is sent to the Central Station (typically 24–30 hours after AC failure) the CPU shuts down until AC POWER is restored, prevents deep battery discharge and loss of CPU memory. When AC power restored, CPU re-arms itself to the same protection level when powered down, reports 95 CPU BACK IN SERVICE when the power comes back on. |
| 92 | 4–7 | CPU TAMPER. CPU shipped with door connected to N/C hardwire tamper input, can be configured either N/O or N/C. Central Station reports 92 ALARM TAMPER LOOP. |
| 94 | 0–8 | RECEIVER FAILURE/RECEIVER JAM. CPU reports "94 RECEIVER FAILURE" if it does not hear from any transmitter for |

TABLE 4-continued

| | | |
|---|---|---|
| | | 2 hours. If a continuous signal on its operating frequency for 2 minutes, it reports "94 RECEIVER JAM". |
| 95 | 0–8 | CPU BACK IN SERVICE. Indicates CPU is in battery saver shut down routine; the AC power is restored and the CPU is BACK IN SERVICE. The CPU re-enters service armed to the same level it was in when it shut down. |
| 96 | 0–8 | FAIL TO COMMUNICATE. Is displayed at the CPU and a trouble tone will sound if the CPU fails to reach the Central Station in 3 attempts. The tone can be silenced by entering the ACCESS CODE +0. If the CPU is armed to Level 5 (silent) and was trying to report an alarm then the police siren is sound. If the subscriber elects not to connect to the Central Station, then 96 does not exist, as it is added to the program by the Central Station operator when the hookup is first made. This alarm gives a local indication only. |

OPTIONAL SENSOR NUMBERS

| S/T Number | Active Levels | Description |
|---|---|---|
| 00 | 0–8 | PHONE FAILURE. If the CPU cannot report a violation for Sensor Numbers 02–82, 86, 92 to the Central Station because of phone line problems it has a hardwire output that can activate a transmitter coded to sensor #00. Another CPU within range of the transmitter can be programmed to report the account number and phone tamper condition of the CPU which originally experienced the alarm condition. |
| 77 | 0–8 | TOUCHPAD TAMPER. If the CPU hears 40 Touchpad signals that do not equal the proper access code, plus a protection level. The Sirens go into audible alarm, (police siren) (silent in Level 5), and report "77 TOUCHPAD TAMPER" to the CS. |
| 84 | 0–8 | OPENING REPORT. If 84 is initialized, the CPU reports "84 OPENING REPORT" when the CPU is disarmed. There are provisions for identifying up to 10 different users of the system. |
| 85 | 0–8 | CLOSING REPORT. If 85 is initialized, the CPU reports "85 CLOSING REPORT" when the CPU is armed. There are provisions for identifying up to 10 different users of the system. |
| 87 | 0–8 | FORCE ARMED. If 87 is initialized, the CPU reports "87 FORCE ARMED" whenever a sensor number is deliberately bypassed by a user. The CPU will report "87 FORCE ARMED AUTO" if it force armed itself. |
| 90 | 0–8 | A/C FAILURE. If 90 is initialized, the CPU reports "90 A/C FAILURE" AC power to the CPU is cut off for 15 minutes. The "Trouble" beeps annunciate locally. This feature should be used only when there is a special need. Otherwise, if ever a city wide power failure occurs, all systems set to report a 90 A/C FAILURE will report at once. |
| 93 | 0–8 | AUTOMATIC PHONE TEST. If 93 is initialized, the CPU reports "93 AUTOMATIC PHONE TEST" to the Central Station at a programmable interval, from daily to every 255 days. If not changed from the Central Station, the report occurs once every 7 days. |
| 97 | 0–8 | NO PHONE LINE. If 97 is initialized, |

TABLE 4-continued

| | |
|---|---|
| | the CPU checks the phone line before attempting any communication with the Central Station. If the phone line is not operational, a 97 alarm is initiated and displayed at the CPU. A Trouble tone sounds every 15 seconds. The tone can be silenced by entering the access code +0. If the CPU is armed to Level 5 (silent) and the CPU was trying to report an alarm signal, then it sounds the police siren immediately. The is a local indication only. |

Each system controller's operation may further be customized by selecting various of the features provided in Table 5. Of these, F04 and F05 control the frequency of low battery and supervisory reports to the central station. F07, in addition to providing visual alarm confirmation, also allows the installer to determine all open sensors during system initialization by merely selecting that feature when in arming level 0-2, which provides a quick check of system integrity without separately examining all sensors/transducers.

TABLE 5

| OPTIONAL FEATURE NUMBERS | |
|---|---|
| Feature | Function |
| F00 | EXIT DELAY SOUNDS. Controls whether exit delay beeps sound once at beginning of exit delay, or continuously for entire length of delay. |
| F01 | TAMPER POLARITY. Controls polarity of Hardwire Tamper input to CPU. |
| F02 | EXTERIOR SIREN DELAY. Contols whether the exterior siren output will be activated immediately or delayed 15 seconds. |
| F03 | DIGITAL COMMUNICATOR. Controls whether system reports alarms to Central Station. |
| F04 | LOW BATTERY REPORTS. Controls whether LOW BATTERIES are reported weekly or not at all. |
| F05 | SUPERVISORY REPORTS. Controls whether uncorrected SUPERVISORIES will re-report to Central Station daily or weekly. |
| F06 | DAILY ABORT. Controls whether dialer aborts calls canceled by user within the first 15-20 seconds. |
| F07 | OPEN SENSOR DISPLAY. Controls whether open sensors displayed on CPU when in protection levels 0, 1 or 2. |
| F10 | SIGNAL STRENGTH INDICATOR. Controls whether CPU performs a customer level 9 sensor test or an installer level 9 sensor test where the sirens hears transmission from a tested sensor. |
| F11 | INTERIOR SIREN SOUNDS. Controls whether Hardwire Interior Sirens produce status and alarm sounds or alarm sounds only. |
| F12 | RESTORE REPORTING. Controls whether CPU reports restorals by zone. |
| F14 | HOURLY PHONE TEST. Controls whether CPU checks every hour to see if the phone line is good. |
| F15 | SENSOR TAMPER. Controls whether CPU treats all sensor tamper signals as alarms in all protection levels. |
| F16 | TROUBLE SOUNDS. Controls whether CPU activates trouble beep (every 60 seconds) upon detection of a low batter or supervisory. |
| F17 | DIRECT BYPASS TOGGLE. Controls whether bypassed sensors can be directly unbypassedl |

S/T GROUP RESPONSE ASSIGNMENTS

Recalling the system's response is predetermined from the pre-programmed tabular listings of RAM 14, Table 6 shows the various S/T numbers (referred to as channels) relative to their group assignments and the system's responding annunciations relative for the various possible arming levels. Of the groupings, the group 10 sensor/transducers are of note in that two of such sensor/transducers must produce an alarm within a four minute period before the system responds with an annunciation. For example, this grouping finds application with passive infrared and motion sensors which may be mounted to in combination confirm the existence of an alarm detected by the other, before reporting same to the central station. Again too, it is to be recalled the central station 4 may re-program the group assignments as necessary.

TABLE 6

| GROUP FUNCTION AND CHANNEL ASSIGNMENT | | | |
|---|---|---|---|
| GROUP | TYPE | OPERATION | CHANNELS |
| 0 | Police/Emergency | Reports in levels 0-8<br>High level modulated siren in levels 0-8 | 3, 3, 6, 77<br>81 |
| 1 | Auxiliary/Medical | Reports in levels 0-8<br>Low level siren in 0-8 | 10-17, 82 |
| 2 | Fire | Reports in levels 0-8<br>High level solid siren in levels 0-8 | 20-27, 80 |
| 3 | Special | Reports in levels 1-8<br>High level modulated siren in levels 1-4 and 6, 7<br>Silent in level 5 | 30-33 |
| 4 | Main entry | Reports in levels 3-7 | 34-37 |

TABLE 6-continued

| GROUP FUNCTION AND CHANNEL ASSIGNMENT | | | |
|---|---|---|---|
| GROUP | TYPE | OPERATION | CHANNELS |
| | | Chime in level 2<br>initiates delay in levels<br>High level modulated siren<br>in levels 3, 4, 6, 7<br>Silent in level 5 | 3–6 |
| 5 | Perimeter | Reports in levels 3–7<br>Chime in level 2<br>High level modulated siren<br>in levels 3, 4, 6, 7<br>Silent in level 5 | 40–57, 92 |
| 6 | Interior delayed | Reports in levels 4–7<br>Disarmed by delay in<br>levels 4, 5, 6<br>High level modulated siren<br>in levels 4, 6, 7<br>Silent in level 5 | 60–63<br>70–72 |
| 7 | Interior delayed | Reports in levels 4 and 5<br>Disarmed by delay<br>High level modulated siren<br>in level 4<br>Silent in level 5 | 64, 65<br>73, 74 |
| 8 | Interior<br>Initiates delay | Reports in levels 4 and 5<br>initiates delay in levels<br>4 and 5<br>High level modulated siren<br>in level 4<br>Silent in level 5 | |
| 9 | Interior<br>initiates delay | Reports in levels 4–7<br>Reports in levels 4–7<br>initiates delay in levels<br>4–6<br>High level modulated siren<br>in levels 4, 6, 7<br>Silent in level 5 | 66, 67<br>75, 76 |
| 10 | Interior delayed<br>2 trip option | Reports in levels 4–7<br>if two alarms signals<br>heard in a 4 minute period<br>Disarmed by delay in<br>levels 4, 5, 6<br>High level modulated siren<br>in levels 4, 6, 7<br>Silent in level 5 | |
| 11 | Monitor | No report<br>Trouble beep in levels<br>0–4 and 6–8<br>High level modulated in level<br>5 if other alarm has occurred | 96, 97 |
| 12 | Monitor | Reports in levels 0–8<br>No sirens | 1, 2, 4, 5<br>7, 86 |
| 13 | Monitor | Reports in levels 0–8<br>No sirens | 83, 87, 90<br>91, 93, 94<br>95, 84–85 |
| 14 | Monitor | Reports in levels 0–8<br>No sirens | |
| 15 | Monitor | Reports in levels 0–8<br>Trouble beeps in levels<br>0–8 | 91 |
| | | SIREN SOUNDS | |
| POLICE SIREN - | | Loud intermittent siren. | |
| FIRE SIREN - | | Loud steady siren. | |
| AUSILIARY SOUNDS - | | Low volume, on-off on-off beeping. | |
| STATUS SOUNDS - | | Low volume beeps indicating current protection level. | |
| PROTEST BEEP - | | Low volume rhythmic beeping. | |
| TROUBLE BEEP - | | Low volume six fast beeps repeated every sixty (60) seconds. | |
| CHIMES BEEP - | | Low volume two beeps. | |
| SENSOR TEST SOUND - | | Loud single tone or series of tones heard. | |

Table 7, in turn, shows the byte organization of the S/T number, arming level and group control flags and the channel flags stored in RAM 14 for the mentioned tabular listings of arming level versus group assignment and individual sensor/transducer number versus channel control data, along with the organization of the buddy control and controller phone dialer flags. As the CPU responds to the control and channel flags of each reporting and/or detected S/T number, group assignment and associated controller arming level, the corresponding channel data is organized and appropriately entered into the alarm buffer and/or event buffer. The central station 4 is thereby either directly made aware of the initiating event and/or the event is noted in the event buffer which may later be referred to by the central station.

TABLE 7

| CONTROLLER PROGRAM FLAGS | | |
|---|---|---|
| CHANNEL CONTROL BITS | | |
| For each S/T number, one byte with the following function: | | |
| Bits | 0–3 | Group number of the channel |
| Bit | 4 | Restore or non-restore channel |
| Bit | 5 | Supervised or non-supervised channel |
| Bit | 6 | Channel requires or does not require a restore before allowing arming |
| Bit | 7 | Channel has or does not have a low battery detector |
| ARMING LEVEL CONTROL BITS | | |
| For each arming level, one byte with the following function: | | |
| Bit | 0 | Open or closed arming mode |
| Bit | 1 | Report cancel on active channels when entering level |
| Bit | 2 | Sound upon entry delay |
| Bit | 3 | Sound upon exit delay |
| Bit | 4 | Prohibit arming entry if low batteries |
| Bit | 5 | Prohibit arming entry if supervisories |
| Bit | 6 | Restricted or non-restricted level |
| Bit | 7 | Valid or non-valid level |
| GROUP TABLE ARM LEVEL | | |
| GROUP FUNCTION BY EACH ARMING LEVEL CONTROL BITS | | |
| For each group vs. arming level, one byte with the following function: | | |
| Bit | 0 | Report or no report to central station 1 = report |
| Bit | 1 & 2 | 00 = no sound on activation<br>01 = low level sound on activation (auxiliary)<br>10 = solid high level activation (fire)<br>11 = modulated high level on activation (burglary) |
| Bit | 3 | Group disarmed by delay |
| Bit | 4 | Group activation initiates delay |
| Bit | 5 | Low level beep on activation (chime) |
| Bit | 6 | High level short blast on activation (level 9 test) |
| Bit | 7 | Trouble beep on activation |
| CHANNEL DATA | | |
| For each S/T channel, two bytes with the following function: | | |
| First byte: | | |
| Bit | 0 | Low batter/trouble flag |
| Bit | 1 | Alarm history flag |
| Bit | 2 | Received from channel flag |
| Bit | 3 | Supervisory flag |
| Bit | 4 | Channel status |
| Bit | 5 | Alarm flag |
| Bit | 6 | Test mode flag |
| Bit | 7 | Activated but disarmed by delay flag |
| Second byte: | | |
| Bit | 0 | Request alarm report flag |
| Bit | 1 | Request supervisory report flag |
| Bit | 2 | Request low battery report flag |
| Bit | 3 | Request cancel report flag |
| Bit | 4 | Initialized flag |
| Bit | 5 | User bypass flag |
| Bit | 6 | Request tamper report flag |
| Bit | 7 | Wait for bypass flag |
| CHANNEL DATA 2 | | |
| For each cannel, one byte with the following function: | | |
| Bit | 0 | Type of sensor |
| Bit | 1 | Zone reported flag |
| Bit | 2 | Not used |
| Bit | 3 | Not used |
| Bit | 4 | Restoral report flag |
| Bit | 5–7 | HIM (1 of 8) |
| BUDDY SYSTEM CONTROL BITS (BUDFLG) | | |
| Bit | 0 | Initialized flag for buddy 1 |
| Bit | 1 | Initialized flag for buddy 2 |
| Bit | 2 | Initialized flag for buddy 3 |

TABLE 7-continued

| CONTROLLER PROGRAM FLAGS | | |
|---|---|---|
| Bit | 3 | Initialized flag for buddy 4 |
| Bit | 4 | Supervisory flag for buddy 1 |
| Bit | 5 | Supervisory flag for buddy 2 |
| Bit | 6 | Supervisory flag for buddy 3 |
| Bit | 7 | Supervisory flag for buddy 4 |
| DIALER FLAGS (DIALFLG) | | |
| Bit | 0 | Recalculate checksum flag |
| Bit | 1 | Fail to communicate flag |
| Bit | 2–3 | Buddy system number in alarm |
| Bit | 4 | Buddy system report flag |
| Bit | 5 | Set time flag |
| Bit | 6 | No phone line flag |
| Bit | 7 | Stop dialer flag if not done dialing |

In the latter regard, Table 8 shows the format of the data which is stored in the event buffer set aside in the CPU's internal RAM. This data reflects a chronological listing of all events which are detected, whether or not reported. It normally contains data regarding arming level changes and which access codes initiated same, along with reported supervisories, alarms, restorals, battery condition, among other data, and the times such data is reported. The central station, in addition to the dynamic listing it makes of reported events at its subscriber systems, can thereby obtain a comprehensive event history listing, if ever required.

Due to space limitations in memory (i.e. 64 events), the event buffer is organized in a flow through configuration. Thus as new data is entered and if the memory is full, old data is pushed out. The controller may also be programmed to periodically produce a hard copy of the memory contents before data is purged. In pass, it might also be noted that "alarm history" flag of the first byte of each group channel data is retained for six hours which permit the user to review system activity to a limited extent by pressing status and scrolling the sensors/transducers.

TABLE 8

| EVENT BUFFER FORMAT | |
|---|---|
| Entry type: Arming level change | |
| Byte 1: | Time LSD |
| Byte 2: | Time MSD |
| Byte 3: | Date LSD |
| Byte 4: | Date MSD |
| Byte 5: | Previous arming level |
| Byte 6: | Channel data bits (lower byte) |
| Byte 7: | Channel data bits (upper byte) |
| Byte 8: | Not used |
| Entry type: Sensor event | |
| Byte 1: | Time LSD |
| Byte 2: | Time MSD |
| Byte 3: | Date LSD |
| Byte 4: | Date MSD |
| Byte 5: | Channel number |
| Byte 6: | Channel data bits (lower byte) |
| Byte 7: | Channel data bits (upper byte) |
| Byte 8: | Channel control bits |

NOTE: Byte 6 has different information for a few sensor numbers:

| Sensor number | Information in byte 6 |
|---|---|
| 00 | Upper nibble is supervisory flags<br>Lower nibble contains buddy number in alarm |
| 01 | Invalid sensor number heard |
| 84 | User number |
| 85 | User number |

Relative to each system controller's interfacing with the central station, it is to be noted five phone modes (PMODES) are provided which are set out in Table 9 below. Generally, the PMODES segment where and via what phone numbers the various alarm reports are directed relative to the available phone lines and allow the controller to interface with a variety of reporting stations.

TABLE 9

| PHONE MODES | |
|---|---|
| PMODE 0: | CPU dials only 1 phone number, the second phone number is not used. CPU powers up in PMODE 0 and no programming is required, if only 1 phone number is to be dialed. |
| PMODE 1: | Second phone number is dialed only if CPU fails to get through to the first number. CPU makes 3 attempts to reach the first number before dialing second number. |
| PMODE 2: | CPU dials first number to report all alarms, except LOW BATTERY and SUPERVISORY which CPU reports to second number. Used by subscriber desiring alarm calls only to go to Central Station and low battery and supervisory calls to go to, for example, a service department. |
| PMODE 3: | CPU dials first number to report all alarm except LOW BATTERY and SUPERVISORY. CPU dials the second number to report everything. Used by subscriber who is monitored by a third party service. Monitoring service would receive only alarm calls, and central station would receive both a record of alarm calls and all low battery reports and supervisory reports. |
| PMODE 4: | CPU dials first number to report all alarms except LOW BATTERY, SUPERVISORY and OPENING and CLOSING reports. The CPU dials the second number to report everything. Used by subscriber monitored by a third party service. Monitoring service would receive only alarm calls, and central station would receive both a record of alarm calls and all low battery, supervisory all opening/closing reports. |

In passing, it should also be noted that the house code buffer provided in the CPU's internal RAM, which the controller uses to monitor incoming transmissions relative to personal and buddy transmissions, is also monitorable by the central station. The central station, rather than the installer, is thus able, upon system initialization, to locally monitor neighbor alarm system traffic to determine the house codes of neighboring systems which in turn might be entered into the buddy system memory of any of the neighboring system controllers.

The central station 4 also has the capability of programming all of the controller's twelve access codes. In particular with reference to Table 10, it can program any of the primary access codes or any of its other secondary or multi-user access codes. Of the various codes, only the primary access codes permit system disarming to any arming level, the bypassing of sensors or the programming of a "babysitter". The secondary access codes, in turn, may be programmed with one of two alternative statuses, hi or low privilege, and depending upon the assigned privilege, the code has limited access to the system's arming levels. Otherwise, only one of the primary access codes, the duress code and babysitter code can be programmed from the key pad 13 or wireless touch pad 12.

TABLE 10

| SYSTEM ACCESS CODES | | | |
|---|---|---|---|
| CODE | DESCRIPTION | PROGRAM FROM | PRIVILEGE STATUS |
| 0 | Primary Access Code | CS, using ACCESS touch-pad by installer | Always Hi |
| 1 | Alternate Primary Access Code | CS only, using Maccess | Always Hi |
| 2 | Secondary Access Code | CS only, using Maccess command or touchpad | Always Low |
| 3–10 | Multi User Access Code | CS only, using Maccess command | Hi or Low |

TABLE 11

```
*
*
*****************************************************************************
*
*
*                ALARM PROCESSING SUBROUTINE FOR SX5
*
*
*****************************************************************************
*
        PUBLIC  ALARM1                  ;ALARM PROCESSING ROUTINE
        PUBLIC  CCRNT                   ;CARRIER CURRENT ROUTINE
        PUBLIC  SIREN                   ;SIREN CONTROL TABLE
        PUBLIC  HARDOUT                 ;HARDWIRE OUTPUT ROUTINE
```

```
*
*  ZERO PAGE RAM DEFINITIONS
*
        EXTERN  PAGE0   ZPBUFPT         ;PANEL POINTER TO ALARM BUFFER
        EXTERN  PAGE0   ZCBUFPT         ;COMMUNICATOR POINTER TO ALARM BUFFER
        EXTERN  PAGE0   ZREMBUF
        EXTERN  PAGE0   ZREMOUT         ;HARDWIRE OUTPUT BUFFER
        EXTERN  PAGE0   ZCHNIN          ;CHANNEL NUMBER RECEIVED
        EXTERN  PAGE0   ZDATREC         ;CHANNEL DATA RECEIVED
        EXTERN  PAGE0   ZOUTBUF         ;DISPLAY OUTPUT BUFFER
        EXTERN  PAGE0   ZREMSHT         ;REMOTE DISPLAY OUTPUT DATA
        EXTERN  PAGE0   ZTEMP6          ;TEMP. STORAGE
        EXTERN  PAGE0   ZTEMP7          ;TEMP. STORAGE
        EXTERN  PAGE0   ZTEST           ;CHANNEL NUMBER TO DISPLAY FOR TEST
        EXTERN  PAGE0   ZTESTL          ;LAST CHANNEL HEARD
        EXTERN  PAGE0   ZINVLD          ;INVALID SENSOR NUMBER HEARD STORAGE
        EXTERN  PAGE0   ZMFLAG1         ;MISC. FLAGS
        EXTERN  PAGE0   ZMFLAG3         ;MISC. FLAGS
        EXTERN  PAGE0   ZRFFLG2         ;RF AND CARRIER CURRENT FLAGS
        EXTERN  PAGE0   ZTIME2          ;ENTRY/EXIT TIMER
        EXTERN  PAGE0   ZSRNCNT         ;SIREN CONTROL REGISTER
        EXTERN  PAGE0   ZAMVSGD         ;ARMING VS GROUP DATA STORAGE
        EXTERN  PAGE0   ZCCSFT          ;NUMBER OF TIMERS TO OUTPUT TO C.C.
        EXTERN  PAGE0   ZAMDATA         ;ARMING MODE DATA STORAGE
        EXTERN  PAGE0   ZCCSBUF         ;CARRIER CURRENT OUTPUT BUFFERS
        EXTERN  PAGE0   ZINTCNT         ;INTERRUPT CONTROL REGISTER
        EXTERN  PAGE0   ZEBUF           ;EVENT BUFFER LOAD ROUTINE VECTOR
        EXTERN  PAGE0   ZABUF           ;ALARM BUFFER LOAD ROUTINE VECTOR
        EXTERN  PAGE0   ZGTENNM         ;SENSOR NUMBER OF LAST GROUP 10 SENSO
        EXTERN  PAGE0   ZLLSSC          ;LOW LEVEL SIREN SHIFT COUNTER
        EXTERN  PAGE0   ZGTENTM         ;RESET TIMER FOR GROUP 10 SENSOR #
        EXTERN  PAGE0   ZRTFLG          ;FLAG REGISTER
        EXTERN  PAGE0   ZSBFLG          ;FLAG REGISTER
*
*  EXTERNAL RAM DEFINITIONS
*
        EXTERN  SUPFL2                  ;BUFFER LOAD ROUTINE
        EXTERN  BATTM                   ;BATTERY TROUBLE BEEP TIMER
        EXTERN  TESTLTM                 ;TESTL RESET TIMER
        EXTERN  BUDFLG                  ;BUDDY SYSTEM FLAGS
        EXTERN  ID                      ;SYSTEM ID NUMBER
        EXTERN  REPBUF                  ;ALARM REPORT BUFFER
        EXTERN  CHNDAT                  ;CHANNEL DATA
        EXTERN  CHNDAT2                 ;CHANNEL DATA
        EXTERN  CHNSUP                  ;CHANNEL SUPER. TIMERS
        EXTERN  SUPFRQ                  ;SUPER. FREQUENCY
        EXTERN  AMGD                    ;ARMING MODE vs. GROUP DATA TABLE
        EXTERN  EETIME                  ;LOWER NIBBLE IS ENTRY DELAY TIME
        EXTERN  SRNDWN                  ;EXIT DELAY & SIREN SHUTDOWN TIME
        EXTERN  PSCHAN                  ;OPTION FLAGS
        EXTERN  PSCHAN2                 ;OPTION FLAGS
        EXTERN  SIRDOWN                 ;SIREN SHUTDOWN TIMER
        EXTERN  CHNCNT                  ;CHANNEL CONTROL TABLE
        EXTERN  CRTARM                  ;CURRENT ARMING LEVEL
        EXTERN  DIALFLG                 ;DIAL FLAG REGISTER
        EXTERN  PLTIME                  ;BANK DISPLAY TIMER
*
*         LOAD THE CHANNEL GROUP #
*
ALARM1  LDA     CHNCNT,Y        GO READ THE GROUP # OF THE CHANNEL & STATUS FL
        STA     ZCHNIN          STORE IN ZCHNIN
*
*  READ ARMING MODE VS GROUP DATA AFTER CALCULATING ADDRESS
*
        AND     #$0F            SAVE LOWER 4 BITS OF GROUP NUMBER
        STA     ZTEMP6          CREATE OFFSET
        LDA     CRTARM          GET ARMING MODE
        ASL     A               SHIFT ARMING MODE
        ASL     A
        ASL     A
```

```
        ASL   A
        ADC   ZTEMP6
        TAX                       GET OFFSET
        LDA   AMGD,X              GO READ ARMING VS GROUP
        STA   ZAMVSGD             STORE IN ZAMVSGD
*
*
        TYA                       LOAD CHANNEL OFFSET
        ASL   A                   MULTIPLY BY 2 FOR PROPER OFFSET
        TAX
        LDA   CHNDAT+1,X          GO READ CHANNEL MEMORY
        BBS   4,A,AL03            TEST IF THIS CHANNEL IS INITIALIZED
        LDA   ZDATREC             GET FLAGS
        BBC   4,A,ALM1            BRANCH IF DATA FROM RF SENSOR
        BBS   0,A,DONE            EXIT IF TROUBLE
ALM1    CPY   #$3F                TEST IF CHANNEL # >76
        BCS   DONE                BRANCH IF CHANNEL NUMBER ABOVE 76
        CPY   #$01                TEST IF CHANNEL 1
        BEQ   DONE                BRANCH IF EQUAL TO CHANNEL 1
ALM2    STY   ZINVLD              STORE INVALID SENSOR NUMBER
        LDY   #$01                SET UP NON-INITALIZED SENSOR HEARD ALARM
        LDM   $08,ZDATREC
        BRA   ALARM1              GO REPORT ALARM
DONE    RTS                       RETURN
*
*     IF BIT 3 OF ZDATREC SET THEN AN ENTRY EXIT FAULT IS SOUCRE OF ALARM
*        IN THAT CASE PROCESS DIRECTLY BECAUSE THE VECTOR
*            DID NOT COME FROM THE SENSOR
*
AL03    LDA   CHNDAT2,Y           GET CHANNEL DATA
        BBC   3,ZDATREC,SET1      TEST BIT 3 OF ZDATREC
AL04    JMP   TY73                GO PROCESS DIRECTLY
*
*     TEST IF HARDWIRE OR RF SENSOR
*
SET1    CPY   #$3F                TEST IF 77 OR ABOVE
        BCS   SET31               BRANCH IF 77 OR ABOVE
SET10   BBC   4,ZDATREC,SET2      BRANCH IF DATA FROM RF SENSOR
*
*     HARDWIRE SENSOR
*
        BBC   0,A,ALM2            01 ALARM IF IT IS SUPPOSE TO BE RF
        EOR   ZDATREC             TEST IF FROM PROPER UNIT
        AND   #$E0
        BBS   0,ZDATREC,SET13     BRANCH IF TROUBLE
SET11   BNE   ALM2                01 ALARM IF FROM WRONG UNIT
        BRA   SET3
*
*  TROUBLE CONDITION SO DON'T SET RECEIVED FLAG
*
SET13   BNE   DONE                EXIT IF NOT THE SAME
        LDA   CHNDAT,X            GET CHANNEL DATA
        BBS   0,A,DONE            BRANCH IF TROUBLE CONDITION ALREADY ON CHANNEL
        BBS   2,ZSBFLG,SET12      BRANCH IF TROUBLE CONDITION ALREADY HAS HAPPEI
        SEB   2,ZSBFLG            SET 4 DAY FLAG
        SEB   2,ZRTFLG            TURN ON TROUBLE BEEPS
        LDA   #$09                SET UP TROUBLE BEEPS RESTART TIMER
        STA   BATTM
SET12   LDA   CHNDAT,X            RELOAD CHANNEL DATA
        BRA   BA77
*
*            SET THE SUPERVISORY FLAG
*
SET2    BBS   0,A,ALM2            01 ALARM IF IT SUPPOSE TO BE HARDWIRE
SET3    LDA   SUPFRQ              GET SUPER. FREQUENCY
        STA   CHNSUP,Y            RESET SUPER. TIMER
        TXA                       TEST IF CHANNEL 0
        BNE   SET4                BRANCH IF IT IS NOT CHANNEL 0
        LDA   BUDFLG              GET BUDDY FLAGS
        AND   #$F0                TEST IF ANY SUPER.
        BEQ   SET4                BRANCH IF NO CHANNEL 0 SUPER.
SET31   LDA   CHNDAT,X            GET CHANNEL DATA
```

```
        BRA   SET5
SET4    LDA   CHNDAT,X          GET CHANNEL DATA
        CLB   3,A               RESET SUPERVISORY FAULT
*
*       DOES CHANNEL HAVE LOW BATTERY OR TAMPER ACCOMPANIED WITH DATA?
*
SET5    BBC   0,ZDATREC,BA76    TEST INCOMING DATA FOR BATTERY OR TAMPER COND.
        BBS   7,ZCHNIN,BA77     TEST ZCHNIN MSB, FROM THE POWER UP TABLE
        SEB   5,ZDATREC         SET UP ALARM CONDITION WITH TAMPER
        SEB   2,ZDATREC
        SEB   1,ZDATREC         SET DOOR OPEN FLAG
*
BA76    CLB   0,A               RESET THE TROUBLE FLAG IN CHANNEL MEMORY
        CLB   2,A               RESET THE TROUBLE REPORTED FLAG
        BRA   KP94
*
*
BA77    SEB   0,A               SET THE BAD BATTERY FLAG IN CHANNEL MEMORY
        BBS   2,A,BA78          BRANCH IF ALREADY REPORTED
        SEB   2,A               SET REPORTED BIT
        STA   CHNDAT,X          STORE DATA
        LDA   CHNDAT+1,X        GET CHANNEL DATA
        SEB   2,A               SET REPORT BITS
        JSR   SUPFL2            GO PUT ON BUFFERS
BA78    LDA   CHNDAT,X          GET CHANNEL DATA
        BBS   4,ZDATREC,DONE    BRANCH IF DATA FROM A HARDWIRE SENSOR
*
*
KP94    CLB   4,A               RESET THE DOOR FLAG
        BBC   4,ZCHNIN,HA92     BRANCH IF THIS IS NOT A RESTORE CHANNEL
        BBC   1,ZDATREC,HA94    BRANCH IF SENSOR RESTORED
        SEB   4,A               SET THE CHANNEL DATA
HA92    STA   CHNDAT,X
        BRA   HA93
HA94    STA   CHNDAT,X
        LDA   CHNDAT2,Y         GET FLAGS
        CLB   1,A               CLEAR REPORTED FLAG
        CPY   ZTESTL            TEST IF SAME NUMBER
        BNE   HACOT             BRANCH IF NOT THE SAME
        LDM   $FF,ZTESTL        RESET LAST SENSOR TESTED
HACOT   BBS   4,A,HACOT1        EXIT IF ALREADY REPORTED RESTORE
        SEB   4,A               SET RESTORAL REPORTED
        STA   CHNDAT2,Y         RETURN CHANNEL DATA
        LDA   PSCHAN2           GET OPTION FLAGS
        BBC   2,A,HA93          EXIT IF NO RESTORE REPORT WANTED
        LDA   CHNDAT+1,X        GET CHANNEL DATA
        BBC   0,A,HA93          EXIT IF CHANNEL NOT IN ALARM
        BBC   0,ZAMVSGD,HA93    BRANCH IF REPORT IS NOT REQUESTED
        JSR   SUPFL2
        BRA   HA93
HACOT1  STA   CHNDAT2,Y         RETURN CHANNEL DATA
*
*
*
HA93    BBC   2,ZDATREC,RNT     RETURN IF NO ALARM
        LDA   #$08              SET UP 1 SECOND RESET OF ZTESTL
        STA   TESTLTM
        CPY   #$43              TEST IF SENSOR  > 82
        BCS   HA95              BRANCH IF SENSOR > 82
        LDA   #$09              SEE IF TEST MODE
        CMP   CRTARM
        BEQ   RF66              BRANCH IF TEST MODE
HA95    BBS   5,ZDATREC,HA55    BRANCH IF A TAMPER
        LDA   ZCHNIN            GET GROUP
        AND   #$0F              SAVE LOWER 4 BITS OF GROUP NUMBER
        CMP   #$0A              TEST IF GROUP 10
        BNE   HA55              BRANCH IF NOT GROUP 10
        LDA   ZGTENTM           GET TIMER
        BEQ   TEN
        CPY   ZGTENNM           TEST IF SAME SENSOR NUMBER
        BNE   HA55              ALARM IF NOT SAME NUMBER
```

```
        BRA   TEN1              EXIT
TEN     BBS   4,ZMFLAG3,HA55    BRANCH IF ALREADY HEARD GROUP
        SEB   4,ZMFLAG3         SET FLAG
        LDA   #$04              LOAD 4 MIN. WINDOW
        STA   GTENTO
        STY   ZGTENNM           STORE SENSOR NUMBER
        LDA   CHNDAT+1,X        GO READ CHANNEL MEMORY
        CLB   0,A               CLEAR ALARM REQUEST
        JSRI  ZEBUF             PUT ON EVENT BUFFER
TEN1    LDM   $08,ZGTENTM       LOAD 1 SEC. TIMEOUT
RNT     RTS                     EXIT
HA55    LDA   CHNDAT+1,X        TEST IF THIS CHANNEL
        BBS   5,A,RNT           BRANCH IF BYPASSED AND RETURN
        LDA   CHNDAT2,Y         GET DATA
        CPY   #$48              TEST IF SENSOR >90
        BCS   HA99              BRANCH IF IT IS
        BBC   0,A,HA88          REPORT IF RF SENSOR
HA99    BBS   1,A,RNT           EXIT ALREADY REPORTED
        SEB   1,A               SET REPORTED FLAG
        STA   CHNDAT2,Y         STORE CHANNEL FLAGS
        BRA   HA88
*
*
RF66    CPY   #$3F              TEST IF > 76
        BEQ   RNT               EXIT IF SENSOR 77
        BCS   TESTD             PROCESS IF > 76
RF67    LDA   PSCHAN2           GET OPTION FLAGS
        BBS   0,A,TESTD         PROCESS IF TEST ALL OPTION IS ON
        BBC   1,ZDATREC,RNT     BRANCH IF DOOR CLOSED
        CPY   ZTESTL            TEST IF IN DISPLAY
        BEQ   RNT               EXIT IF ALREADY TESTED
TESTD   STY   ZTEST             FLASH DISPLAY
        STY   ZTESTL
        SEB   3,ZSRNCNT         CREATE THE TEST MODE SIREN NOISE
        LDA   CHNDAT,X
        SEB   6,A               SET TEST MODE FLAG
        LDY   #$01              LOAD NUMBER OF TIMERS TO SEND TO CCS
        BRA   EXMW1
*
*****************************************************************************
*
*           THIS CHANNEL WAS JUST ACTIVATED AND IT WAS NOT BYPASSED
*
HA88    BBC   5,ZDATREC,HA90    BRANCH IF NOT A TAMPER
        LDA   PSCHAN2           GET OPTION FLAGS
        BBC   5,A,HA90          BRANCH IF TAMPER AS ALARM OPTION NOT ON
        LDM   $07,ZAMVSGD       SET HIGH LEVEL MODULATED AND REPORT
        JMP   TY73
HA90    LDA   ZSRNCNT           LOAD SIREN CONTROL REG. AND SAVE IN ZTEMP6
        STA   ZTEMP6
        LDA   ZAMVSGD           GET ARMING MODE VS. GROUP DAT
        BBC   5,A,TY98          TEST LOW LEVEL BLAST, BRANCH IF NO LOW LEVEL
*
*       SET LOW LEVEL .5 SECOND BLAST IN SIREN COMMAND REGISTER R26
*
        CPY   ZTESTL
        BEQ   TY98
        BBC   1,ZDATREC,TY98    BRANCH IF DOOR CLOSED
        SEB   2,ZSRNCNT
        STY   ZTESTL
*
*       TEST FOR TROUBLE BEEPS
*
TY98    BBC   7,A,TY99
        SEB   2,ZRTFLG
*
*       TEST FOR HIGH LEVEL
*
TY99    BBC   6,A,TX41          TEST FOR HIGH LEVEL SHORT BLAST COMMAND
*
*       SET HIGH LEVEL COMMAND IN SIREN CONTROL REGISTER
*
```

```
        SEB   3,ZSRNCNT
*
*
TX41    AND   #$87              TEST IF SIREN OR REPORT IS NEEDED
        BNE   TX27              CONTINUE IF ANY THING IS ACTIVE
        LDY   #$01              LOAD NUMBER OF TIMERS TO SEND TO CCS
        LDA   ZSRNCNT           LOAD SIREN CONTROL REG.
        EOR   ZTEMP6            TEST IF IT HAS CHANGED (CARRIER CURRENT NEEDE
        BNE   EXIT              RETURN WITH CCNT
LAMB    RTS                     RETURN FROM SUBROUTINE
*
*       DOES SYSTEM INITIATE ENTRY DELAY
*
TX27    BBS   5,ZDATREC,TY73    BRANCH IF A TAMPER, NO DELAY FOR TAMPER
        BBC   4,ZAMVSGD,TU31    TEST IF INITIATES DELAY
*
*       IS CHANNEL CURRENTLY IN EXIT DELAY
*
        LDA   #$0C              LOAD MASK FOR ENTRY EXIT FLAGS
        AND   ZMFLAG1
        BNE   TU31              IF IT IS DO NOT REINITIALIZE
*
*       SET UP ENTRY DELAY
*
        LDA   EETIME            READ ENTRY DELAY FROM MEMORY
        AND   #$F0
        STA   ZTIME2            STORE ENTRY TIME IN ZTIME2 COUNTER
        SEB   2,ZMFLAG1         SET THE ENTRY FLAG IN ZMFLAG1
        LDY   #$03              LOAD NUMBER OF TIMES TO OUTPUT TO WIS
        BBC   2,ZAMDATA,ST22    BRANCH IF NO SOUND ON ENTRY
        SEB   1,ZSRNCNT         SET THE CONTINOUS SHIFT FLAG
*
*          SET THE ACTIVATED BUT DISARMED BY DELAY FLAG
*
ST22    LDA   CHNDAT,X          FETCH THE CHANNEL DATA
        SEB   7,A               SET FLAG
EXMW1   STA   CHNDAT,X
EXIT    JMP   RTRN              RETURN AND INITIALIZE CARRIER CURRENT
*
*******************************************************************************
*       IS THIS CHANNEL DISARMED BY DENTRY OR EXIT DELAY COUNTERS
*******************************************************************************
*
*      TEST FOR DISARMED BY DELAY
*
TU31    LDA   CHNDAT,X
        BBC   3,ZAMVSGD,TY73    BRANCH IF NOT DISARMED BY DELAY
*
*       IS DELAY TIMER RUNNING?
*
        BBS   2,ZMFLAG1,TU32
        BBC   3,ZMFLAG1,TY73    CHECK IF CURRENTLY IN ENTRY OR EXIT DELAYS
*
*       SET 'ACTIVATED BUT DISARMED BY DELAY' FLAG X7
*
TU32    SEB   7,A
LIP37   STA   CHNDAT,X
        RTS                     RETURN FROM SUBROUTINE
*******************************************************************************
*
*                GENERATE ALARM REQUEST REPORT
*
*******************************************************************************
TY73    SEB   7,ZOUTBUF+3       TURN DISPLAY BACK ON
        LDA   #$05              TURN ON FOR 5 MINUTES
        STA   PLTIME
        LDA   CHNDAT,X          GET CHANNEL DATA
        SEB   5,A               SET ALARM LATCH FLAG
        STA   CHNDAT,X
        LDA   ZCHNIN            LOAD THE GROUP #
        AND   #$0F              REMOVE THE UPPER NIBBLE
        STA   ZTEMP6            SAVE
```

```
*
*     ZREMBUF IS A SERIAL DEVICE BUFFER
*
          SEB   0,ZOUTBUF+3       SET ALARM FLAG (1 = ALARM)
          LDA   ZREMBUF           LOAD ZREMBUF
          AND   #$F0              REMOVE GROUP#
          ORA   ZTEMP6            ADD NEW GROUP#
          STA   ZREMBUF           RETURN TO BUFFER
*
*  TEST IF ALARM OCCURRED FLAG SHOULD BE SET
*
          TXA                     GET CHANNEL OFFSET
          LSR   A                 DIVIDE FOR CHANNEL NUMBER
          CPX   #$02              TEST IF SENSOR 01
          BEQ   REP1              BRANCH IF 01
          CPX   #$86              TEST ALARM OCCURED FLAG SHOULD BE SET
          BCC   REP0              BRANCH IF <83
          CPX   #$8C              TEST IF 86
          BEQ   REP0              BRANCH IF 86
          CPX   #$94              TEST IF 92
          BNE   REP1              BRANCH IF NOT
REP0      SEB   1,ZRTFLG          SET ALARM OCCURED FLAG
REP1      BBC   0,ZAMVSGD,REP3    BRANCH IF REPORT IS NOT REQUESTED
          CPX   #$7E              TEST IF CHANNEL # =>77
          BCS   REPORT            REPORT ALARM IF CHANNEL NUMBER ABOVE 76
*
*     TEST IF ALARM ALREADY ON BUFFER. IF IT IS DON'T PUT IT ON AGAIN
*
          LDY   ZCBUFPT           GET COMMUNICATOR ALARM BUFFER POINTER
TEST      CPY   ZPBUFPT           TEST IF THE SAME AS PANEL POINTER
          BEQ   REPORT            REPORT IF EQUAL
          CMP   REPBUF,Y          TEST IF ALREADY ON BUFFER
          BEQ   TESCHN            TEST IF ALARM REPORT
          INY                     POINT TO NEXT CHANNEL
          INY
          BRA   TEST2             CONTINUE TEST
TESCHN    INY                     POINT TO CHANNEL DATA
          INY
          LDA   REPBUF,Y          GET CHANNEL DATA
          BBS   0,A,PTEQU         EXIT IF THE SAME
TEST2     INY                     POINT TO NEXT CHANNEL
          TXA                     RESTORE CHANNEL NUMBER
          LSR   A                 DIVIDE TO GET CHANNEL NUMBER
          BRA   TEST              CONTINUE TEST
*
*     PUT CHANNEL IN ALARM BUFFER
*
REPORT    TXA                     TEST IF SENSOR 00
          BNE   REP2              BRANCH IF NOT SENSOR 00
          LDA   DIALFLG           GET DIALER FLAGS
          SEB   4,A               SET SPECIAL REPORT NEEDED
          STA   DIALFLG
          BRA   REP3
REP2      LDA   CHNDAT+1,X        GET CHANNEL DATA FLAGS
          SEB   0,A               SET REQUEST ALARM REPORT FLAG
          STA   CHNDAT+1,X
          BBC   5,ZDATREC,REP2A   BRANCH IF NOT A TAMPER
          SEB   6,A               SET TAMPER REPORT FLAG
REP2A     JSRI  ZABUF             GO PUT DATA IN ALARM BUFFER
          TXA                     GET CHANNEL OFFSET
          LSR   A                 MAKE INTO CHANNEL NUMBER
          TAY                     PUT IN REG. Y FOR OFFSET
          LDA   CHNDAT2,Y         GET CHANNEL DATA
          CLB   4,A               CLEAR RESTORAL REPORTED FLAG
          STA   CHNDAT2,Y         PUT CHANNEL DATA BACK
REP3      LDA   CHNDAT+1,X        GET CHANNEL DATA FLAGS
          SEB   0,A               SET REQUEST ALARM REPORT FLAG
          BBC   5,ZDATREC,REP3A   BRANCH IF NOT A TAMPER
          SEB   6,A               SET TAMPER REPORT FLAG
REP3A     JSRI  ZEBUF             GO PUT DATA IN EVENT BUFFER
```

```
*****************************************************************
*                                                               *
*       GENERATE ALARM SIREN COMMAND TO ZSRNCNT SIREN BUFFER    *
*                                                               *
*****************************************************************
PTEQU   BBS   2,ZAMVSGD,CKO     BRANCH IF HIGH LEVEL
        BBC   1,ZAMVSGD,RTRNS   BRANCH IF NO SIREN SOUND
        SEB   6,ZSRNCNT         SET CONTINOUS LOW LEVEL
        BRA   RTRNS             BRANCH IF ONLY LOW LEVEL
*
*       SET SHUT DOWN TIMER
*
CKO     LDA   SRNDWN            LOAD SHUT DOWN TIME
        LSR   A                 PUT IN LOWER NIBBLE
        LSR   A
        LSR   A
        LSR   A
        STA   SIRDOWN           STORE SHUT DOWN TIMER TIMER
        BBS   1,ZAMVSGD,PP44    BRANCH IF HIGH LEVEL MODULATED
*
*       SET HIGH LEVEL
*
        SEB   4,ZSRNCNT         SET HIGH LEVEL CONTINOUS
        BRA   RTRNS
*
*       SET HIGH LEVEL MODULATED IF ALARM HAS OCCURRED
*
PP44    BBC   1,ZRTFLG,RTRNS    BRANCH IF NO ALARM HAS OCCURED
        SEB   5,ZSRNCNT
*
RTRNS   LDY   #10               LOAD NUMBER OF TIMES TO SEND TO CCS
RTRN    STY   ZCCSBUF           SET # OF TIMES TO SEND TO CARRIER CURRENT SIR
*
*             RETURN FROM ALARM SUBROUTINE
*
        RTS
*
*
*
*************************************************************************
*
*             CARRIER CURRENT OUTPUT LOADING SUBROUTINE
*
*************************************************************************
*
CCRNT   LDM   $FF,ZCCSFT+5
        LDM   $01,ZCCSFT+4      PUT PREAMBLE IN CARRIER CURRENT SHIFT BUFFER
        LDM   $00,ZTEMP7        INITALIZE NIBBLE CHECK SUM
        LDX   ID                LOAD THE SYSTEM ID #
        STX   ZCCSFT+3          STORE IN CARRIER CURRENT SHIFT BUFFER
        STX   ZCCSFT            INITALIZE BYTE CHECK SUM
        JSR   NCHECK            GO CALCULATE NIBBLE CHECK SUM
*
        LDX   ZSRNCNT           LOAD SIREN CONTROL WORD
        STX   ZCCSFT+2          STORE IN CARRIER CURRENT SHIFT BUFFER
        JSR   NCHECK            GO CALCULATE NIBBLE CHECK SUM
*
        TXA                     GET SIREN CONTROL WORD
        LDX   #$01              LOAD NUMBER OF TIMES TO SHIFT
        JSR   BCHECK            GO SHIFT BYTE FOR BYTE CHECK SUM
*
        LDA   CRTARM            GET CURRENT ARMING LEVEL
        TAX                     SAVE FOR LATER USE
        CLC                     CLEAR CARRY FOR ADD
        ADC   ZTEMP7            UPDATE CHECK SUM
        AND   #$0F              SAVE ONLY LOWER NIBBLE
        STA   ZTEMP7            SAVE CHECK SUM
        TXA                     GET ARMING LEVEL
        ASL   A                 PUT IN UPPER NIBBLE
        ASL   A
        ASL   A
```

```
        ASL   A
        ORA   ZTEMP7          GET NIBBLE CHECK SUM
        STA   ZCCSFT+1        PUT IN SHIFT BUFFER
        LDX   #$02            LOAD NUMBER OF TIMES TO SHIFT
        JSR   BCHECK          GO SHIFT BYTE FOR BYTE CHECK SUM
*
*
        CLB   5,ZRFFLG2       CLEAR LOOKING FOR EDGE FLAG
        SEB   6,ZRFFLG2       SET DATA READY FLAG
*
        RTS                   RETURN
*
*       SUBROUTINE TO CALCULATE NIBBLE CHECK SUM
*
NCHECK  TXA                   GET BYTE
        LSR   A               GET UPPER NIBBLE
        LSR   A
        LSR   A
        LSR   A
        CLC                   CLEAR CARRY FOR ADD
        ADC   ZTEMP7          GET REST OF CHECK SUM
        STA   ZTEMP7          UPDATE THE CHECK SUM IN ZTEMP7
        TXA                   LOAD SIREN CONTROL AGAIN
        CLC                   CLEAR CARRY FOR ADD
        ADC   ZTEMP7          UPDATE WITH LOWER NIBBLE
        STA   ZTEMP7          RETURN
        RTS                   RETURN FROM SUBROUTINE
*
*       SUBROUTINE TO SHIFT BYTE FOR BYTE CHECK SUM
*
BCHECK  CLC                   CLEAR CARRY FOR SHIFT
        ROR   A               SHIFT RIGHT 1 BIT
        BCC   CONT            CONTINUE IF CARRY CLEAR
        SEB   7,A             SET MSB
CONT    DEX                   DECREMENT COUNTER
        BNE   BCHECK          BRANCH IF NOT DONE
        CLC                   CLEAR CARRY FOR ADD
        ADC   ZCCSFT          ADD TO BYTE CHECK SUM
        STA   ZCCSFT          STORE BYTE CHECK SUM
        RTS
*
*
*
*******************************************************************************
*
*    CALCULATE REMOTE DISPLAY OUTPUT FOR NEXT INTERRRUPT
*
*******************************************************************************
*
HARDOUT SEB   6,ZMFLAG3       DISABLE OUTPUT
        LDY   #$06            INITALIZE STORE POINTER
        LDA   ZREMSHT         LOAD FIRST BYTE TO OUTPUT
        EOR   #$80            COMPLEMENT UNITS TO SEND FLAG
        STA   ZREMOUT+7       STORE IN HARDWIRE SHIFT BUFFER
        STA   ZREMOUT         INITALIZE BYTE CHECK SUM
        AND   #$87            CLEAR ACK/NAK FLAGS
        STA   ZREMSHT         STORE NEW UNITS TO SEND FLAG AND ACK/NAK FLAGS
*
        LDA   ZOUTBUF+3       GET LED DRIVE INFO
        LDX   #$01            LOAD NUMBER OF TIMES TO SHIFT
        JSR   BCHECK2         GO SHIFT BYTE FOR BYTE CHECK SUM
*
        LDA   ZOUTBUF+2       GET LSB OF 7 SEGMENT DRIVE INFO
        LDX   #$02            LOAD NUMBER OF TIMES TO SHIFT
        JSR   BCHECK2         GO SHIFT BYTE FOR BYTE CHECK SUM
*
        LDA   ZOUTBUF+1       GET MSB OF 7 SEGMENT DRIVE INFO
        LDX   #$03            LOAD NUMBER OF TIMES TO SHIFT
        JSR   BCHECK2         GO SHIFT BYTE FOR BYTE CHECK SUM
*
        LDA   ZOUTBUF         GET PROTECTION 7 SEGMENT DRIVE INFO
```

```
        LDX   #$04              LOAD NUMBER OF TIMES TO SHIFT
        JSR   BCHECK2           GO SHIFT BYTE FOR BYTE CHECK SUM
*
        LDA   ZREMBUF           GET REST HARDWIRE INFO
        LDX   #$05              LOAD NUMBER OF TIMES TO SHIFT
        JSR   BCHECK2           GO SHIFT BYTE FOR BYTE CHECK SUM
*
*
        LDA   ID                GET SYSTEM ID
        LDX   #$06              LOAD NUMBER OF TIMES TO SHIFT
        JSR   BCHECK2           GO SHIFT BYTE FOR BYTE CHECK SUM
*
*
        SEB   5,ZMFLAG3         SET OUTPUT START BIT FLAG
        CLB   6,ZMFLAG3         ENABLE OUTPUT
        RTS                     RETURN
*
*       SUBROUTINE TO SHIFT BYTE FOR BYTE CHECK SUM FOR HARDWIRE UNITS
*
BCHECK2 STA   ZREMOUT,Y         STORE IN HARDWIRE SHIFT BUFFER
BCHECK3 CLC                     CLEAR CARRY FOR SHIFT
        ROR   A                 SHIFT RIGHT 1 BIT
        BCC   CONT2             CONTINUE IF CARRY CLEAR
        SEB   7,A               SET MSB
CONT2   DEX                     DECREMENT COUNTER
        BNE   BCHECK3           BRANCH IF NOT DONE
        CLC                     CLEAR CARRY FOR ADD
        ADC   ZREMOUT           ADD TO BYTE CHECK SUM
        STA   ZREMOUT           STORE BYTE CHECK SUM
        DEY                     DECREMENT STORE POINTER
        RTS
*******************************************************************************
*
*       SIREN CONTROL MAP
*
*********************************************************************
SIREN   DB    $80
        DB    $07
*
        DB    $00
        DB    $04
*
        DB    $00
        DB    $05
*
        DB    $40
        DB    $05
*
        DB    $50
        DB    $05
*
        DB    $54
        DB    $05
*
        DB    $40
        DB    $07
*
        DB    $50
        DB    $07
*
        DB    $54
        DB    $07
*
        DB    $55
        DB    $07
*
        DB    $33
        DB    $33
*
        DB    $D6
        DB    $5A
```

```
*
        DB      $00
        DB      $50
*
        END
*
```

TABLE I2

```
*
*****************************************************************************
*
*       EVENT AND ALARM BUFFER ENTRY SUB-ROUTINES FOR THE SX5
*
*****************************************************************************
*
        PUBLIC  EVENTS
        PUBLIC  ALMBUF1
*
* ZERO PAGE DEFINITIONS
*
        EXTERN  PAGE0   ZEVNTPT         ;EVENT BUFFER POINTER
        EXTERN  PAGE0   ZPBUFPT         ;PANEL ALARM BUFFER POINTER
        EXTERN  PAGE0   ZINVLD          ;INVALID SENSOR NUMBER STORAGE
        EXTERN  PAGE0   ZYSAVE          ;REG. Y SAVE REGISTER
        EXTERN  PAGE0   ZRTFLG          ;REAL TIME FLAG REGISTER
*
* EXTERNAL RAM DEFINITIONS
*
        EXTERN  HWTFLG                  ;HARDWIRE TOUCHPAD SUPER. FLAGS
        EXTERN  TOD                     ;REAL TIME OF DAY
        EXTERN  DAYCAL                  ;DAY OF YEAR
        EXTERN  CHNDAT                  ;CHANNEL DATA
        EXTERN  CHNCNT                  ;CHANNEL CHARACTERISTICS
        EXTERN  PRVARM                  ;PREVIOUS ARMING LEVEL
        EXTERN  DIALFLG                 ;DIALER FLAGS
        EXTERN  CRTARM                  ;CURRENT ARMING LEVEL
        EXTERN  REPBUF                  ;REPORT BUFFER
        EXTERN  BUDFLG                  ;BUDDY SYSTEM FLAGS
        EXTERN  USER                    ;LAST USER NUMBER
        INCLUDE C:MACRO.ASM
*
*****************************************************************************
*
*
*
EVENTS  PHA                     SAVE CHANNEL DATA
        STY     ZYSAVE          SAVE REG. Y
        LDA     TOD             GET TIME OF DAY
        LDY     #$00            INITALIZE REG. Y
        BBC     3,ZRTFLG,EVENT1 TEST IF ARMING LEVEL CHANGE, BRANCH IF IT NOT
        SEB     7,A             SET FLAG TO CENTRAL STATION
EVENT1  JSR     INCPT           GO INCREMENT EVENT BUFFER POINTER
        LDA     TOD+1           GET REST OF TIME
        JSR     INCPT           GO INCREMENT EVENT BUFFER POINTER
        LDA     DAYCAL          GET DAY OF YEAR
        JSR     INCPT           GO INCREMENT EVENT BUFFER POINTER
        LDA     DAYCAL+1        GET REST OF DAY OF YEAR
        JSR     INCPT           GO INCREMENT EVENT BUFFER POINTER
        TXA
*
* REPORT EVENT SO PUT REPORT INFORMATION ON BUFFER
*
        LSR     A               DIVIDE BY TWO TO GET CHANNEL NUMBER
        BBC     3,ZRTFLG,STORE0 TEST IF ARMING LEVEL CHANGE, BRANCH IF IT NOT
        LDA     PRVARM          GET PREVIOUS ARMING LEVEL
STORE0  JSR     INCPT           GO INCREMENT EVENT BUFFER POINTER
        JSR     DETR            GO DETERMINE INFORMATION TO STORE
        BBC     3,ZRTFLG,STORE3 TEST IF ARMING LEVEL CHANGE, BRANCH IF IT NOT
        LDA     CRTARM          GET CURRENT ARMING LEVEL
```

```
STORE3  JSR     INCPT           GO INCREMENT EVENT BUFFER POINTER
        PLA                     GET REST OF CHANNEL DATA
        PHA                     SAVE CHANNEL DATA
        BBC     3,ZRTFLG,STORE4 TEST IF ARMING LEVEL CHANGE, BRANCH IF IT NOT
        LDA     USER            GET USER NUMBER
STORE4  JSR     INCPT           GO INCREMENT EVENT BUFFER POINTER
*
*  LOAD LAST BYTE, IF ARMING LEVEL CHANGE THE BYTE HAS NO MEANING
*
        TXA                     ADJUST POINTER
        LSR     A
        TAX
        LDA     CHNCNT,X        GET CHANNEL CONTROL FLAGS
        JSR     INCPT           GO INCREMENT EVENT BUFFER POINTER
        TXA                     RESTORE POINTER
        ASL     A
        TAX
        CLB     3,ZRTFLG        CLEAR ARMING LEVEL CHANGE FLAG
RETURN  PLA                     RESTORE CHANNEL DATA
RETURN1 LDY     ZYSAVE          RESTORE REG. Y
        RTS                     RETURN
*
* INCREMENT EVENT BUFFER POINTER SUB-ROUTINE
*
INCPT   STA     (ZEVNTPT),Y     STORE ACCUM. IN EVENT BUFFER
INCPT1  INC     ZEVNTPT         INCREMENT LOWER BYTE OF POINTER
        BNE     DONE            EXIT IF NOT ZERO
        INC     ZEVNTPT+1       INCREMENT UPPER BYTE OF POINTER
        BBC     1,ZEVNTPT+1,DONE BRANCH IF NOT TIME TO RESET
        CLB     1,ZEVNTPT+1     RESET POINTER TO TOP OF BUFFER ($A4)
DONE    RTS                     RETURN
*
*
*******************************************************************************
*
*       ALARM BUFFER LOAD SUB-ROUTINE
*
*******************************************************************************
*
ALMBUF1 PHA                     SAVE CHANNEL DATA
        STY     ZYSAVE          SAVE Y REG.
        TXA                     GET CHANNEL OFFSET
        LSR     A               DIVIDE TO GET CHANNEL NUMBER
        JSR     ALMSTR          STORE CHANNEL NUMBER IN BUFFER
        JSR     DETR            GO DETERMINE WHAT TO STORE
ALMST2  JSR     ALMSTR          STORE IN BUFFER
        PLA                     GET REST OF CHANNEL DATA
        JSR     ALMSTR          STORE IN BUFFER
        BRA     RETURN1         RETURN
*
*******************************************************************************
*
*  STORE DATA IN ALARM BUFFER SUBROUTINE
*
ALMSTR  LDY     ZPBUFPT         GET ALARM BUFFER POINTER
        STA     REPBUF,Y        STORE DATA IN ALARM BUFFER
        INC     ZPBUFPT         INCREMENT POINTER
        RTS                     RETURN
*
*******************************************************************************
*
*  SUBROUTINE TO DETERMINE WHAT TO LOAD
*
DETR    LDA     CHNDAT,X        GET CHANNEL DATA
        CPX     #$7E            TEST IF SENSOR 77
        BNE     STORE1          BRANCH IF NOT
        LDA     HWTFLG          GET FLAGS
STORE1  CPX     #$02            TEST IF SENSOR 01
        BNE     STORE2          BRANCH IF NOT 01
        LDA     ZINVLD          GET INVALID SENSOR NUMBER
```

```
STORE2  CPX     #$00            TEST IF SENSOR 00
        BNE     ST20            BRANCH IF NOT 00
        LDA     DIALFLG         GET DIALER FLAGS
        AND     #$0C            GET RID OF UNWANTED BITS
        STA     ZINVLD          USE ZINVLD AS TEMP. STORAGE, NOT USED NOW
        LDA     BUDFLG          GET SUPERVISSORY FLAGS
        AND     #$F0            SAVE ONLY SUPER. FAILURE FLAGS
        ORA     ZINVLD          GET REST OF INFO
ST20    CPX     #$88            TEST IF SENSOR 84
        BEQ     ST21            BRANCH IF IT IS
        CPX     #$8A            TEST IF SENSOR 85
        BNE     ST22            BRANCH IF NOT
ST21    LDA     USER            GET USER NUMBER
ST22    RTS                     RETURN
*
*
        END
*
*
```

While the invention has been described with respect to its presently preferred embodiment and various modifications and improvements contemplated by Applicant, it is to be appreciated that still other changes might be made thereto. Accordingly, it is contemplated the following claims should be interpreted to include all those equivalent embodiments within the spirit and scope thereof.

What is claimed is:

1. In a security alarm network including a plurality of transducers, wherein each transducer communicates status data to a system controller of one of a plurality of subscriber systems and wherein each system controller communicates received transducer data to a central station, an improvement comprising:

(a) at least one system controller including means for detecting an incapacitated communications link of said at least one system controller to said central station and further including means for transmitting an inability-to-communicate (IC) alarm to at least one other of said plurality of system controllers; and (b) means coupled to at least one other of said plurality of system controllers responsive to a received IC alarm for communicating the identity of the incapacitated system controller to the central station.

2. Apparatus as set forth in claim 1 wherein said IC alarm transmitter means is operative only during a period when said at least one system controller is attempting to communicate a transducer alarm to the central station.

3. Apparatus as set forth in claim 1 wherein each system controller includes means for storing identification data communicated by and to which each subscriber system is responsive and wherein the central station includes means for accessing and for programming the identification storage means of each subscriber system controller to respond to an IC alarm of at least one other system controller.

4. Apparatus as set forth in claim 1 wherein said IC alarm transmitter means comprises a radio frequency (RF) transmitter and the communication means coupled to each of the others of said plurality of system controllers includes RF receiver means responsive thereto and whereby the others of said plurality of system controllers receive the identity of the incapacitated system controllers.

5. Apparatus as set forth in claim 4 wherein each subscriber system includes at least one radio frequency (RF) reporting transducer, wherein each system controller includes for receiving RF communications means and means for storing identification data of RF communications to which each system controller is to respond.

6. Apparatus as set forth in claim 5 wherein the central station includes means for accessing the identification means of each of the plurality of system controllers and means for programming the identity of at least one other of the plurality of system controllers and whereby each system controller is responsive to an IC alarm of one of the other system controllers.

7. Apparatus as set forth in claim 5 wherein the identification means of each system controller is programmable with data identifying each subscriber system to the central station and data identifying each transducer to each system controller.

8. Apparatus as set forth in claim 5 wherein each system controller includes means responsive during a programming mode to a predetermined first status transmission of a transducer for programming the identity of the transducer into the identification means and thereby enabling said system controller to respond thereafter to RF communications from the identified transducer whenever its identification data is received.

9. An improved security alarm system controller which monitors and communicates status information to a remote central station from a plurality of local alarm reporting transducers distributed about a subscriber premises comprising:

(a) means for receiving reported status communications from a plurality of wireless transducers;

(b) means responsive during a system controller programming mode to a predetermined transducer status condition for addressably storing the identity of each transducer communicating said status condition during said programming mode in a transducer assignment memory and thereafter limiting the response of said system controller to only transducers identified in said assignment memory;

(c) means for addressably storing each identified transducer relative to a plurality of prioritized alarm groupings, wherein each group defines a plurality of transducers which communicate in response to a predetermined alarm condition;

(d) means for addressably storing a plurality of system arming levels relative to each identified transducer;

(e) means for addressably storing system controller response data arranged relative to the group type of each reporting transducer and a system arming level; and (f) processor means programmably responsive to transducer reported status and identification data and a selected arming level for accessing said group data means and response data means to define a local system response and communications to said central station.

10. Apparatus as set forth in claim 9 including means responsive to a transducer reported alarm for preventing the system controller from reporting the alarm to the central station until at least one other transducer of a group including the first reporting transducer reports a confirming alarm.

11. Apparatus as set forth in claim 9 including microphone means coupled to said processor means and wherein said processor means includes means responsive to central station control signals for coupling said microphone means to a telephone communication link between said system controller and said central station whereby said central station may audibly monitor a subscriber site.

12. Apparatus as set forth in claim 9 coupled in a network including a second system controller which receives status communications from a plurality of wireless transducers in a second subscriber system and which communicates with said central station and wherein:

(a) the first system controller includes means responsive to an inability-to-communicate (IC) condition with said central station for broadcasting at radio frequencies an IC alarm; and (b) said second system controller includes means for receiving said IC alarm and for identifying the condition of the first system controller to the central station.

13. Apparatus as set forth in claim 12 wherein said second system controller includes means for storing identification data of communications received from each subscriber system and wherein the central station includes means for accessing the identification storage means of said second system controller and means for programming said second system controller to respond to an IC alarm of said first system controller.

14. Apparatus as set forth in claim 9 wherein said system controller includes:

(a) means responsive to control signals from said central station for programmably storing a plurality of selectable primary, secondary and user access codes; and (b) means responsive to an entered access code for limiting the arming levels to which said system controller may be programmed.

15. Apparatus as set forth in claim 14 wherein said system controller includes:

(a) a user keypad coupled thereto; and (b) means responsive to a predetermined duress code received from said keypad for communicating an alarm to said central station and not annunciating a local system response.

16. A security alarm network including a remote central station independently communicating with each of first and second subscriber alarm systems, wherein each subscriber system includes a system controller for monitoring a plurality of local transducers and communicating status information to the central station, wherein each transducer reports identification and status data and wherein each system controller includes:

(a) means for receiving reported data from a plurality of hardwired transducers;

(b) means for receiving reported data from at least one wireless transmitter;

(c) means for addressably storing identification data defining each transducer relative to one of said first and second subscriber systems and relative to a plurality of prioritized alarm groupings, wherein each group defines a plurality of transducers which communicate in response to a predetermined local alarm condition (d) means for addressably storing a plurality of system arming levels relative to each identified transducer;

(e) means for addressably storing system controller response data relative to each alarm group and a system arming level;

(f) processor means programmably responsive to transducer reported status and identification data and a selected arming level for accessing said group data means and response data means to define a local system response and communications to said central station;

(g) means for monitoring a communications link to said central station and including wireless transmitter means responsive to an inability-to-communicate (IC) condition for transmitting an IC alarm to the receiver means of said second subscriber alarm system; and (h) means at the system controller of said second subscriber system responsive to a received IC alarm for identifying the incapacitated system controller to the central station.

17. Apparatus as set forth in claim 16 wherein said hardwired transducer receiving means includes a first portion having a plurality of separately identifiable transducers coupled thereto and wherein each transducer is coupled between first and second conductors extending from said system controller and wherein said first portion includes means responsive to the identification data of each of said transducers for individually communicating the status of each of said transducers to said central station.

18. Apparatus as set forth in claim 17 wherein ones of said transducers are coupled between third and fourth conductors said third and fourth conductors are respectively coupled to said first and second conductors.

19. Apparatus as set forth in claim 16 wherein said hardwired transducer receiving means includes a first portion having means for responding to a plurality of separately identifiable transducers coupled between first and second conductors extending from said system controller and further includes a second portion having means coupled to a plurality of separately identifiable hardwired input means (HIM), wherein each HIM is coupled to a plurality of transducers, for periodically communicating the status of all of the transducers coupled to each HIM to said central station.

20. In a security alarm network including a central station monitoring a plurality of subscriber alarm systems, wherein each subscriber alarm system includes a system controller which monitors and communicates status information to the central station for a plurality of assigned reporting alarm transducers distributed about a subscriber premises and wherein ones of which transducer communications are heard by a receiver means at ones of the neighboring system controllers, a method for reporting system controller communication failures comprising the steps of:

(a) programming each system controller with the identity of at least one neighbor system whose transducer transmissions it receives;

(b) monitoring a phone link at each system controller to the central station;

(c) upon detecting an inability-to-communicate (IC) condition at the phone link of one of said system controllers, broadcasting an IC alarm identifying the malfunctioning system controller; and (d) detecting said IC alarm at at least one neighbor system controller and communicating to the central station the identity of the malfunctioning system controller.

21. A method as set forth in claim 20 including the step of monitoring transducer transmissions heard by each subscriber system via the central station to learn the identity of neighbor systems having overlapping transducer transmissions and programming each system controller to communicate the IC alarm of at least one neighbor system.

22. A method as set forth in claim 20 wherein said IC alarm may be broadcast only during a transducer alarm condition.

23. A security alarm network including a remote central station monitoring first and second subscriber alarm systems, wherein each subscriber system includes a system controller for monitoring a plurality of local transducers and communicating status information to the central station, wherein each transducer reports identification and status data and wherein each system controller includes:

(a) means for receiving reported data from a plurality of hardwired transducers;

(b) means for receiving reported data from at least one wireless transmitter;

(c) means for addressably storing identification data defining each transducer relative to one of said first and second subscriber systems and relative to a plurality of prioritized alarm groupings, wherein each alarm group defines a plurality of transducers which communicate in response to a predetermined local alarm condition;

(d) means for addressably storing a plurality of system arming levels relative to each identified transducer;

(e) means for addressably storing system controller response data relative to each alarm group and a system arming level;

(f) processor means programmably responsive to transducer reported status and identification data and a selected arming level for accessing said group data means and response data means to define a local system response and communications to said central station; and (g) random access memory means for chronologically storing each detected system event and wherein the central station includes means for accessing and reviewing the event storage means.

24. In a first security alarm system controller which monitors and communicates status information to a remote central station from at least one wireless transducer at a first subscriber premises and which also receives communications of wireless transducers intended for a second system controller at a second subscriber premises that also communicates with the central station, an improvement comprising:

(a) means at said second system controller for storing data identifying said first system controller; and (b) means coupled to said storing means for detecting an alarm transmitted by said first system controller defining an inability-to-communicate condition with said central station and including means for communicating the identity and incapacitated condition of the first system controller to the central station.

25. In a security alarm system, a method for assigning each of a plurality of wireless transducers to a system controller comprising the steps of:

(a) enabling said system controller into a programming mode;

(b) sequentially inducing each of a plurality of wireless transducers to transmit a predetermined status condition and identification data; and (c) sequentially flagging a plurality of addressable memory locations of a memory means at said system controller corresponding to the identity of each transmitting transducer and whereby said system controller is thereafter responsive to each of said plurality of transducers.

26. In a security alarm system controller which monitors and communicates status information to a central station for a plurality of wireless transducers distributed about a subscriber premises, transducers assignment means comprising:

(a) means responsive during a system controller programming mode to identification data and a predetermined status transmission received with each transducer communication for storing the identity of each transducer communicating the predetermined status condition in an assigned transducer storage means; and (b) means for limiting said system controller to respond only to transducer communications received from transducers identified in the assigned transducer storage means.

27. Apparatus as set forth in claim 26 wherein said assigned transducer storage means comprises a read only memory means having a plurality of data locations addressable via the identification data of said plurality of wireless transducers and wherein said system controller includes means for responding to only transducers communicating identification data defining a data location containing a predetermined flag.

* * * * *